US012722037B2

(12) United States Patent
Ju et al.

(10) Patent No.: US 12,722,037 B2
(45) Date of Patent: Sep. 1, 2026

(54) FREEWHEEL ADJUSTABLE WHEEL AND FITNESS BIKE THEREWITH

(71) Applicant: LG Electronics Inc., Seoul (KR)

(72) Inventors: Jong Kyu Ju, Seoul (KR); Sunggyu Koh, Seoul (KR); Min Seok Kim, Seoul (KR); Hyunghoon Park, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 57 days.

(21) Appl. No.: 18/720,967

(22) PCT Filed: Sep. 13, 2023

(86) PCT No.: PCT/KR2023/013755

§ 371 (c)(1),
(2) Date: Jun. 17, 2024

(87) PCT Pub. No.: WO2024/111835

PCT Pub. Date: May 30, 2024

(65) Prior Publication Data

US 2025/0073524 A1 Mar. 6, 2025

(30) Foreign Application Priority Data

Nov. 25, 2022 (KR) ..... 10-2022-0160700
Feb. 17, 2023 (KR) ..... 10-2023-0021326

(51) Int. Cl.
*A63B 21/22* (2006.01)
*A63B 21/005* (2006.01)
*A63B 22/06* (2006.01)

(52) U.S. Cl.
CPC ..... *A63B 21/225* (2013.01); *A63B 21/0051* (2013.01); *A63B 22/0605* (2013.01)

(58) Field of Classification Search
CPC . A63B 21/005; A63B 21/0051; A63B 21/157; A63B 21/225; A63B 21/227; A63B 22/0605; A63B 24/0087; A63B 2209/08
See application file for complete search history.

(56) References Cited

U.S. PATENT DOCUMENTS 5,882,274 A 3/1999 Shoge
5,944,638 A 8/1999 Maresh et al.
(Continued)

FOREIGN PATENT DOCUMENTS

CN 2753924 Y 1/2006
CN 103818186 A * 5/2014 ..... F16D 41/24
(Continued)

*Primary Examiner* — Gary D Urbiel Goldner
(74) *Attorney, Agent, or Firm* — Birch, Stewart, Kolasch & Birch, LLP

(57) ABSTRACT

A freewheel adjustable wheel may include a rotating gear rotated by power transmitted from a pedal unit, a fixing case rotatably supporting the rotating gear, an inner case mounted inside the fixing case, a clutch bearing disposed between the rotating gear and the inner case, a first gear, a drive unit fixed to the fixing case and supplying rotation power, and a moving gear moved by the rotation power of the drive unit. In addition, the moving gear may be operated in a non-freewheel mode of being engaged with the first gear and a freewheel mode of being spaced apart from the first gear.

20 Claims, 15 Drawing Sheets

(56) References Cited

U.S. PATENT DOCUMENTS

| | | | | |
|---|---|---|---|---|
| 7,758,475 | B2 * | 7/2010 | Goldberg | A63B 22/0605 482/57 |
| 10,328,303 | B2 * | 6/2019 | Frank | A63B 69/0057 |
| 10,398,933 | B2 * | 9/2019 | Crist | A63B 22/0023 |
| 10,888,736 | B2 * | 1/2021 | Fedriga | A63B 24/0087 |
| 11,110,743 | B2 * | 9/2021 | Miles | B60B 27/023 |
| 11,633,647 | B2 * | 4/2023 | Fedriga | A63B 24/0075 482/5 |
| 12,220,613 | B2 * | 2/2025 | Koh | A63B 21/157 |
| 2003/0224911 | A1 | 12/2003 | Warner et al. | |
| 2005/0221960 | A1 * | 10/2005 | Miyamaru | A63B 22/0605 482/8 |
| 2011/0118086 | A1 * | 5/2011 | Radow | A63B 21/00196 482/5 |
| 2012/0048671 | A1 * | 3/2012 | Kozak | B60B 27/047 192/64 |
| 2014/0110208 | A1 * | 4/2014 | Braedt | B60B 27/023 192/46 |
| 2015/0065308 | A1 | 3/2015 | Golesh et al. | |
| 2020/0353310 | A1 | 11/2020 | Bissonnette et al. | |
| 2022/0134179 | A1 | 5/2022 | Taylor et al. | |
| 2022/0347515 | A1 | 11/2022 | Muhic et al. | |
| 2023/0122235 | A1 * | 4/2023 | Ashby | A63B 21/0051 482/57 |
| 2023/0321481 | A1 | 10/2023 | Koh et al. | |
| 2025/0001238 | A1 * | 1/2025 | Hong | A63B 21/0051 |
| 2025/0032850 | A1 * | 1/2025 | Kim | A63B 71/0619 |
| 2025/0152998 | A1 * | 5/2025 | Kim | A63B 21/0052 |
| 2025/0177801 | A1 * | 6/2025 | Kim | A63B 24/0087 |

FOREIGN PATENT DOCUMENTS

| | | | | | |
|---|---|---|---|---|---|
| CN | 213724633 | U | | 7/2021 | |
| KR | 10-2004-0069303 | A | | 8/2004 | |
| KR | 10-2004-0101846 | A | | 12/2004 | |
| KR | 20-2011-0001325 | U | | 2/2011 | |
| KR | 20120031415 | A | * | 4/2012 | B62K 23/06 |
| KR | 10-1317610 | B1 | | 10/2013 | |
| KR | 20-0472220 | Y1 | | 4/2014 | |
| KR | 10-1641429 | B1 | | 7/2016 | |
| KR | 20170035760 | A | * | 3/2017 | A63B 22/00 |
| KR | 10-1723404 | B1 | | 4/2017 | |
| KR | 10-2055442 | B1 | | 12/2019 | |
| KR | 10-2020-0032566 | A | | 3/2020 | |
| KR | 10-2279531 | B1 | | 7/2021 | |
| KR | 10-2022-0033118 | A | | 3/2022 | |
| KR | 10-2022-0046235 | A | | 4/2022 | |
| KR | 10-2022-0111398 | A | | 8/2022 | |
| KR | 10-2466703 | B1 | | 11/2022 | |
| TW | 327160 | B | | 2/1998 | |
| TW | 202224725 | A | | 7/2022 | |

* cited by examiner

[Fig. 1]
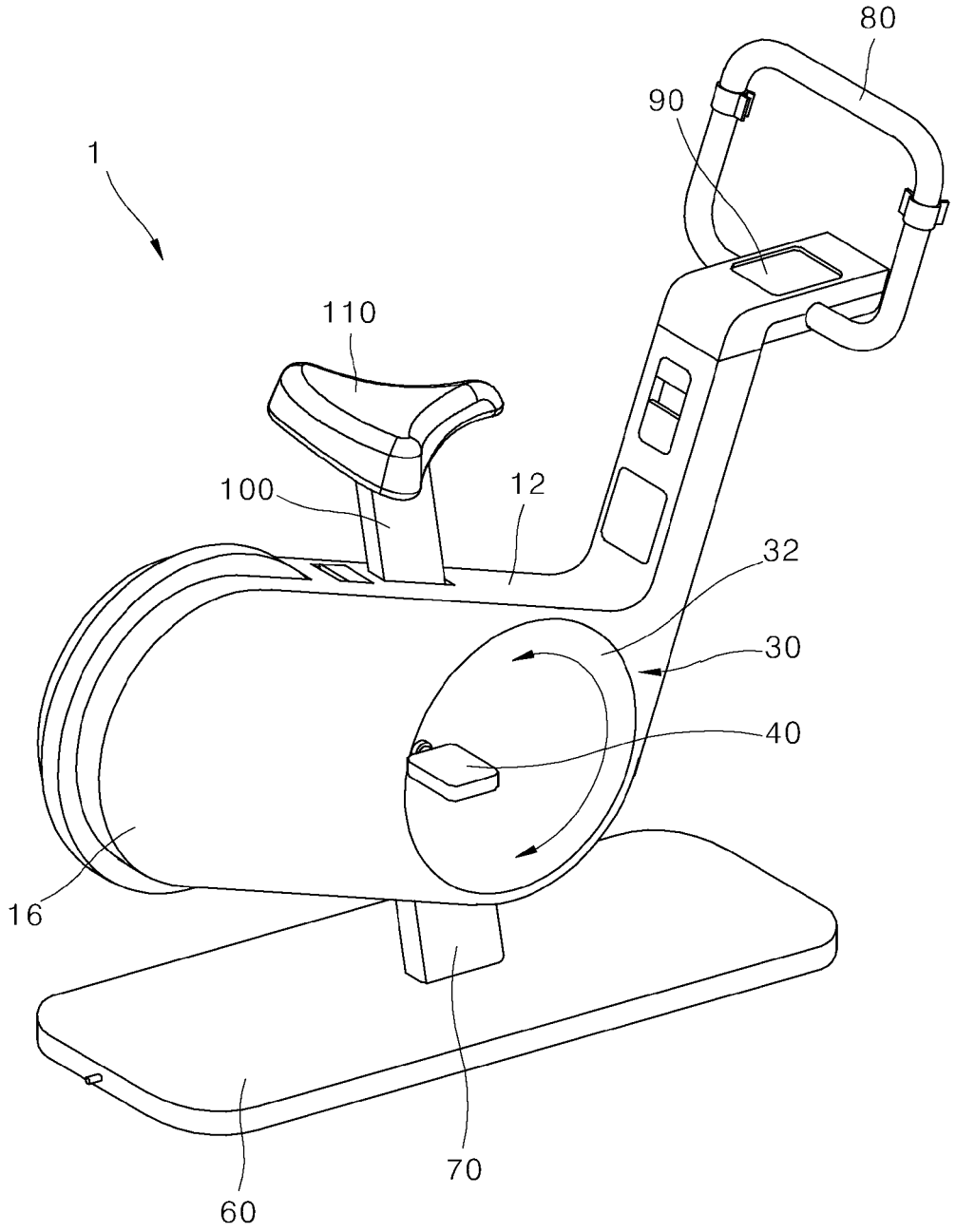

[Fig. 2]
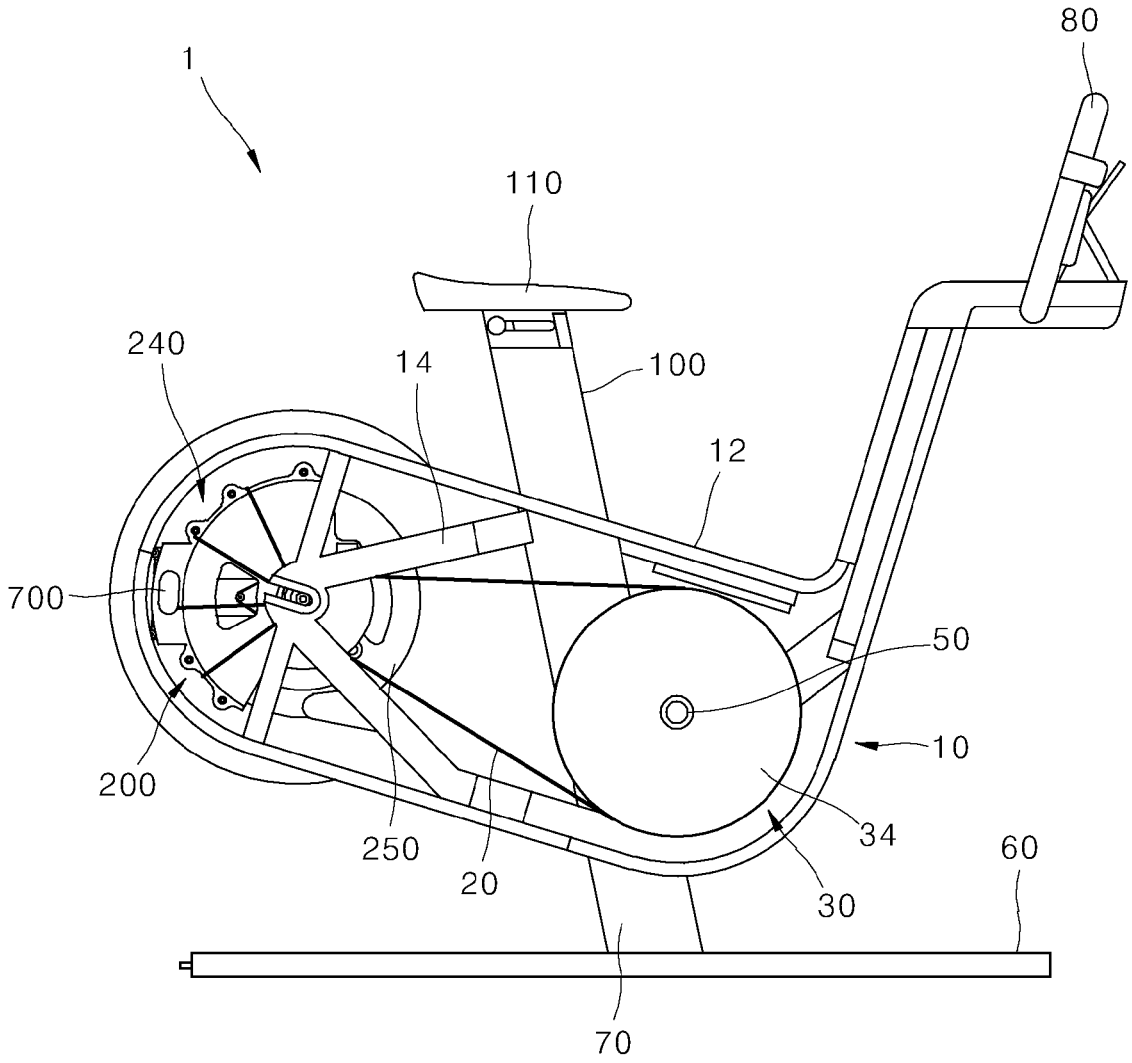

[Fig. 3]
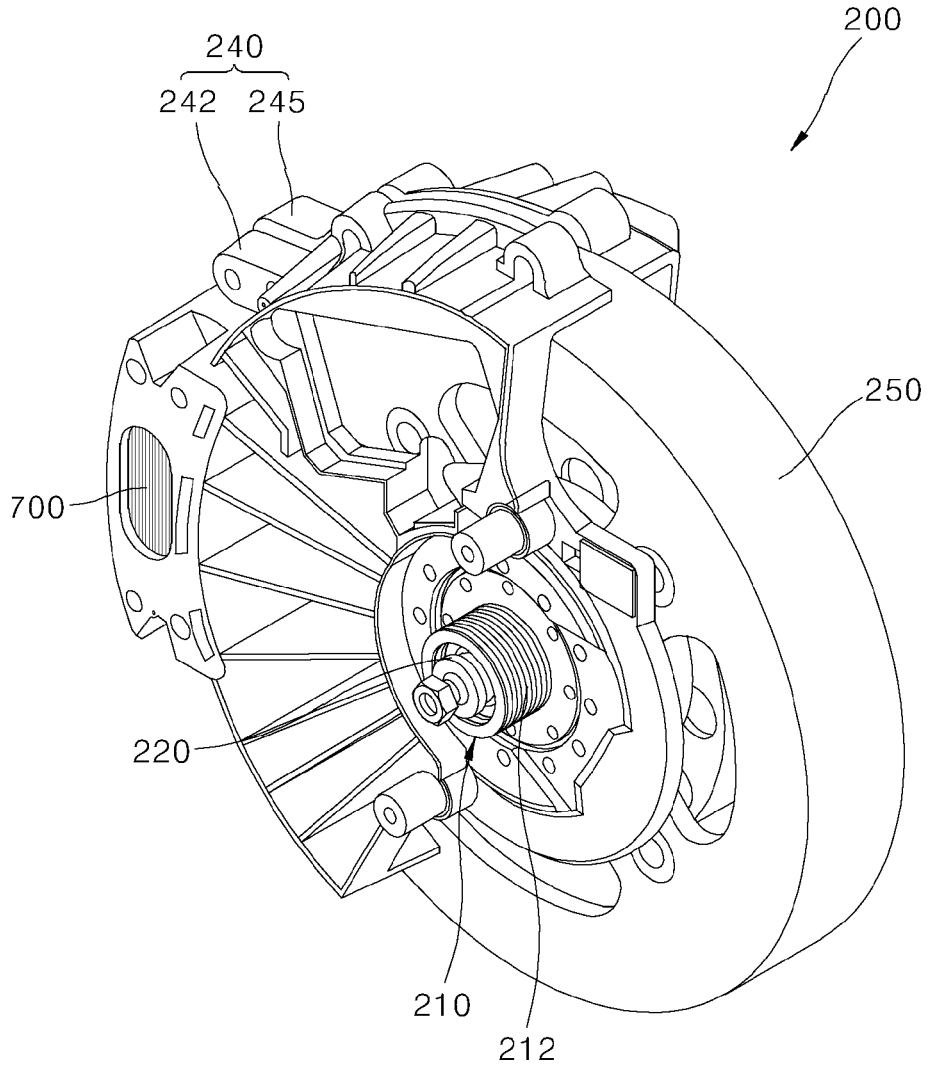

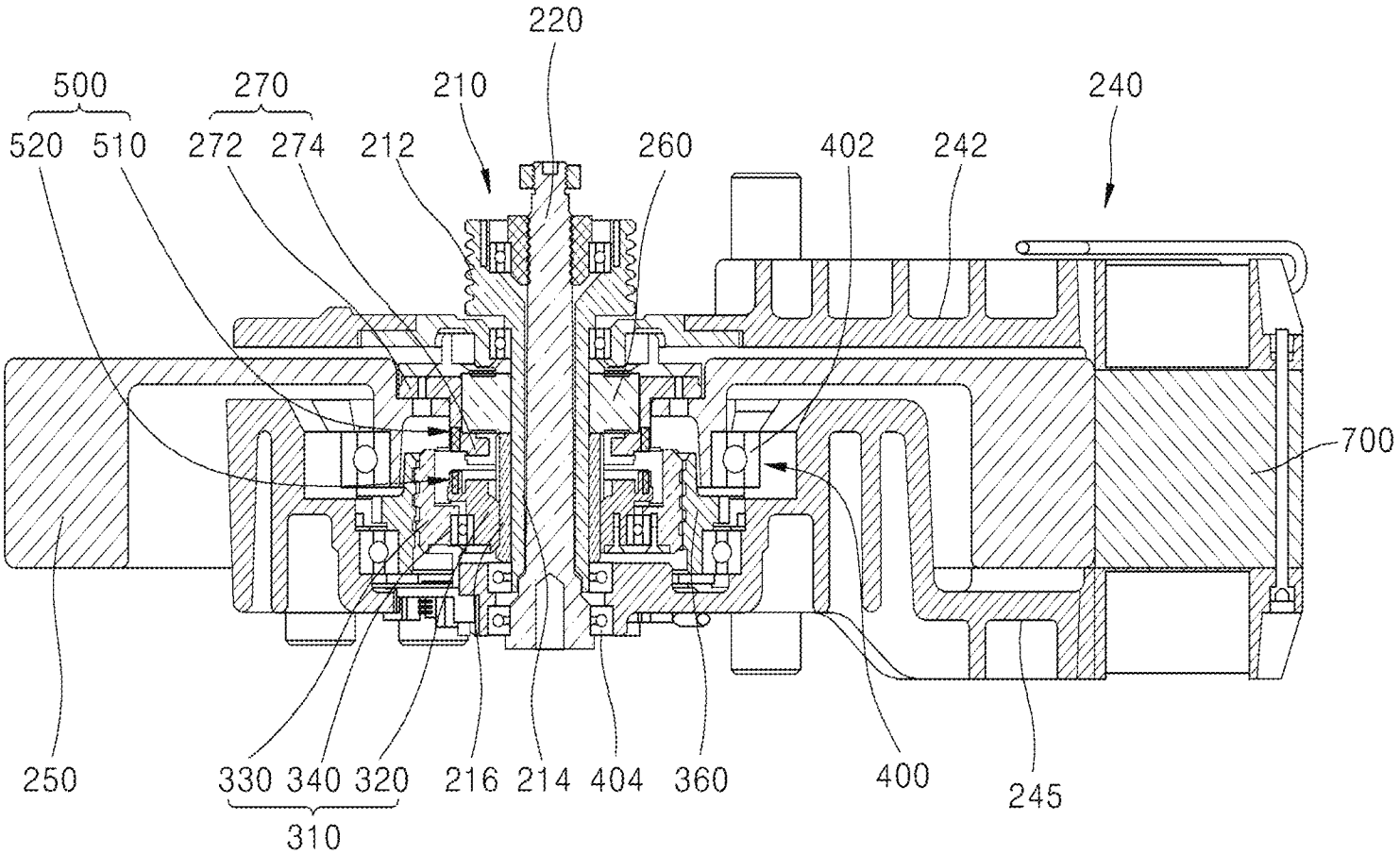
[Fig. 4]

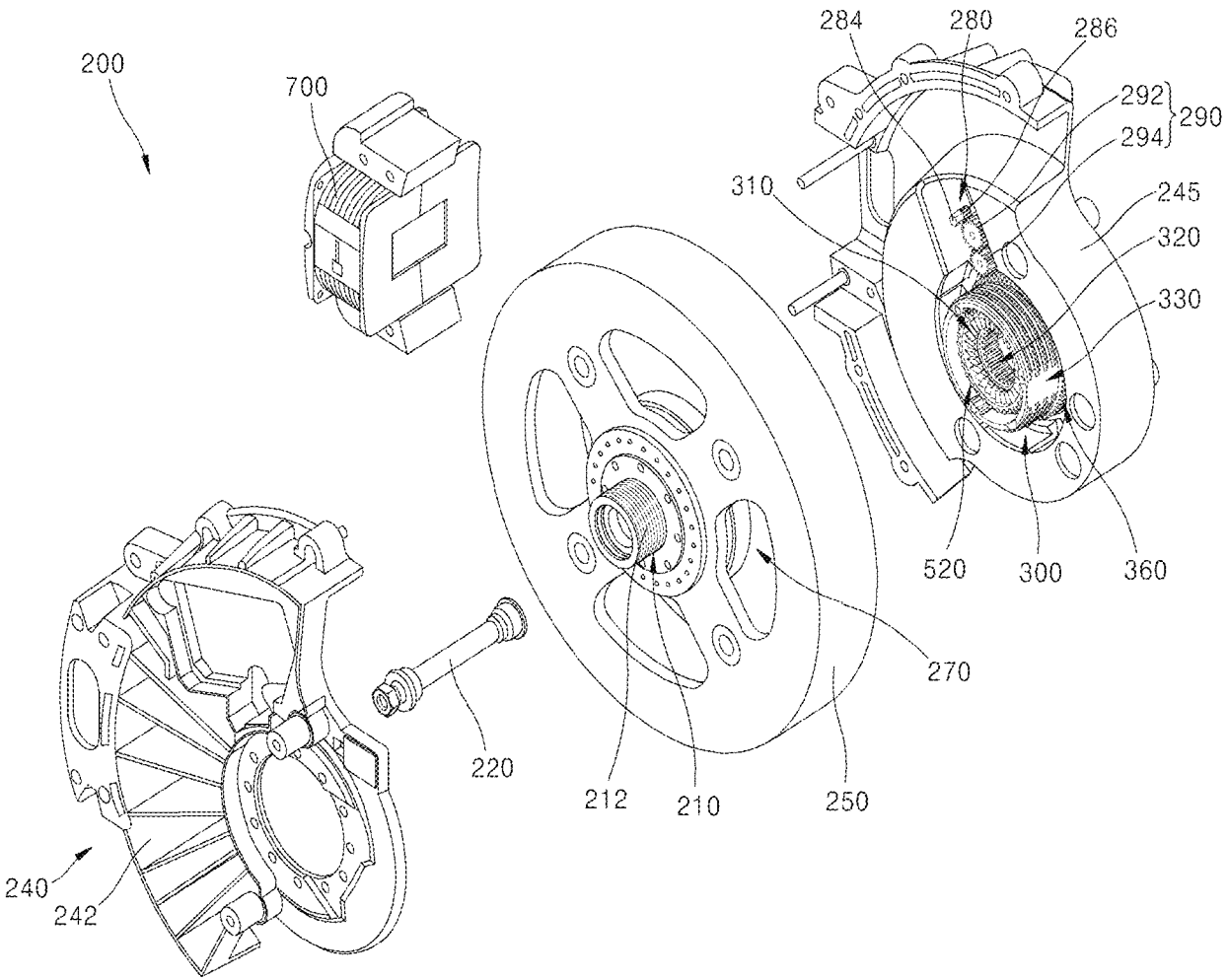
[Fig. 5]

[Fig. 6]
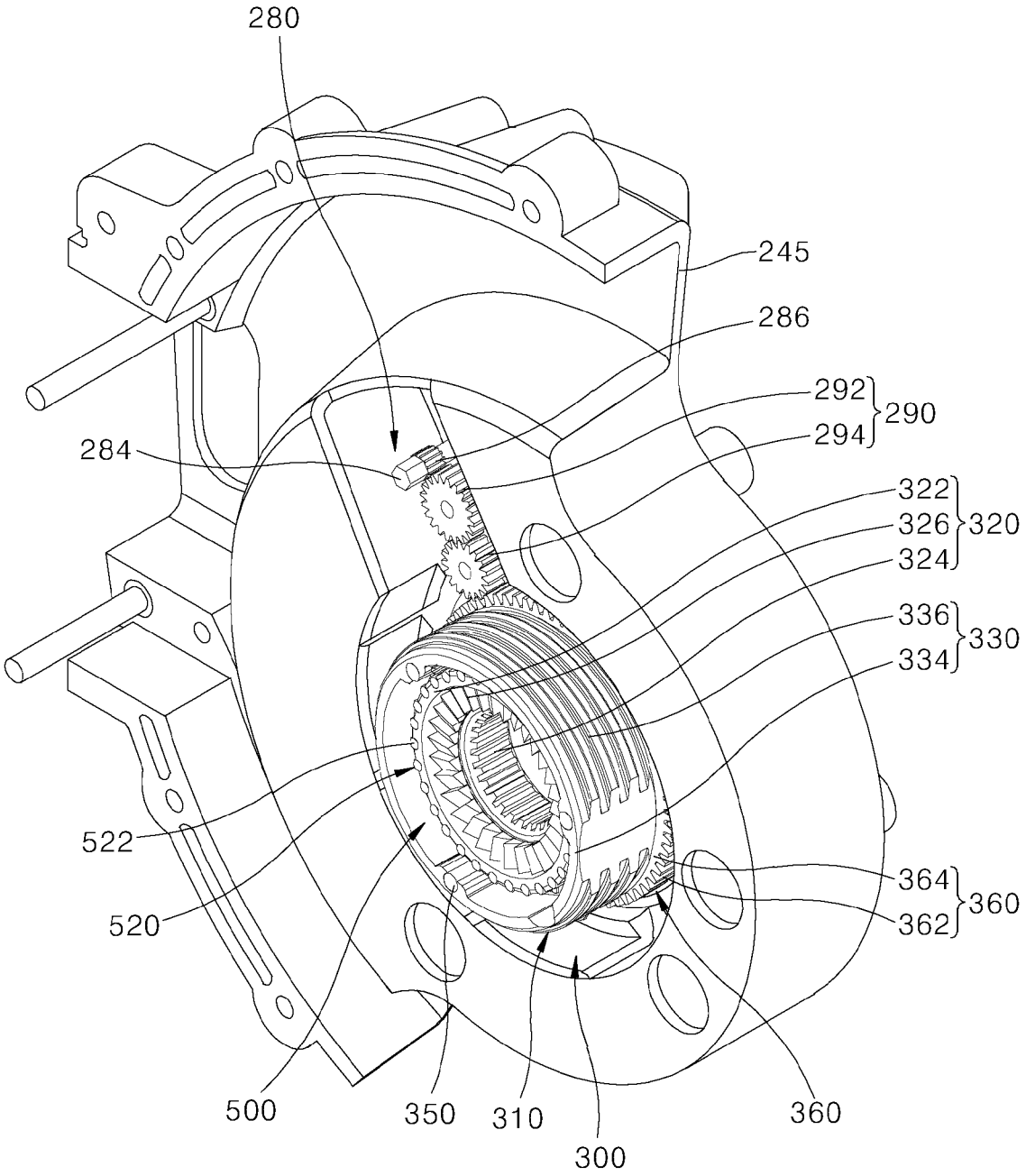

[Fig. 7]
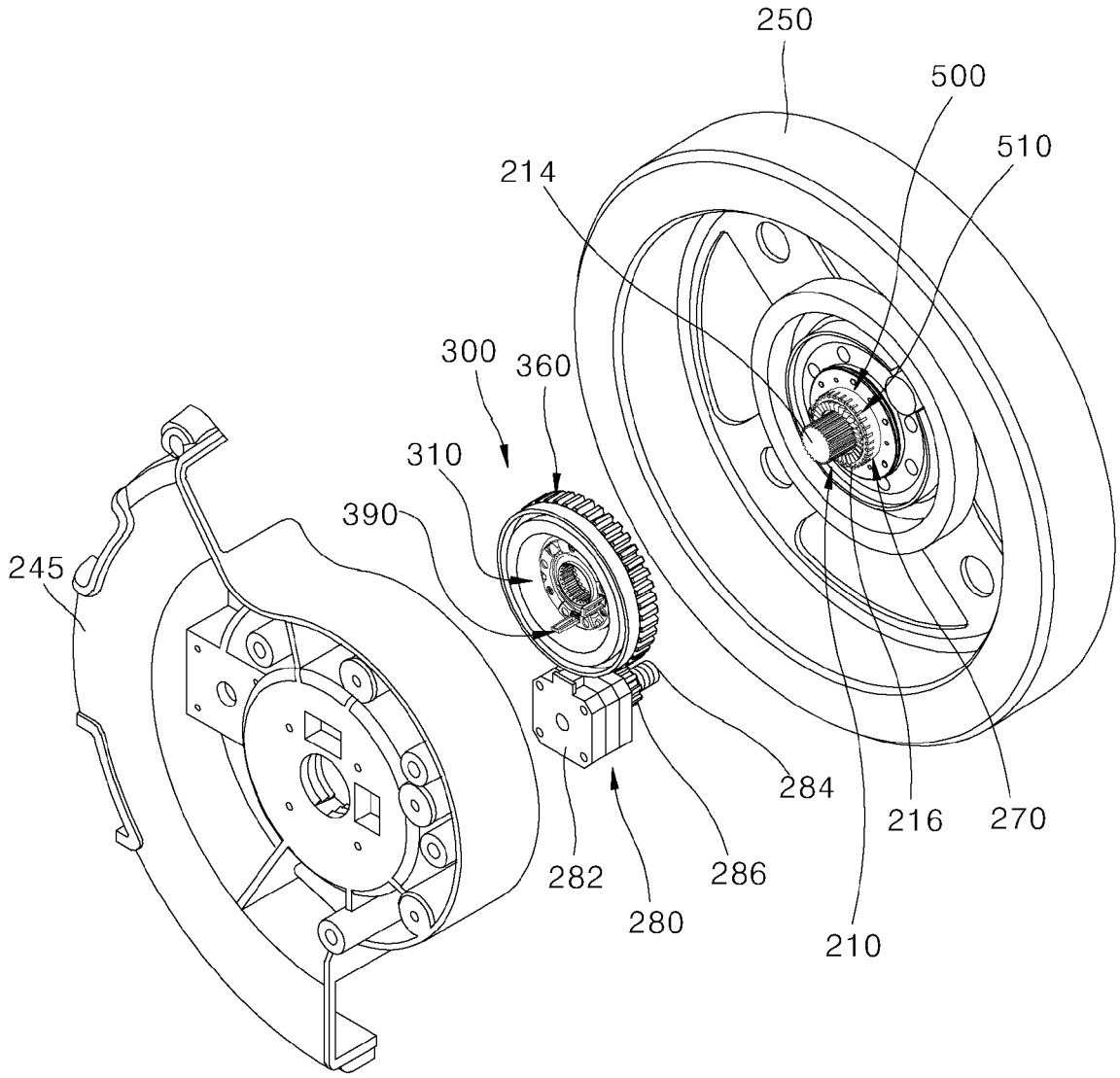

[Fig. 8]
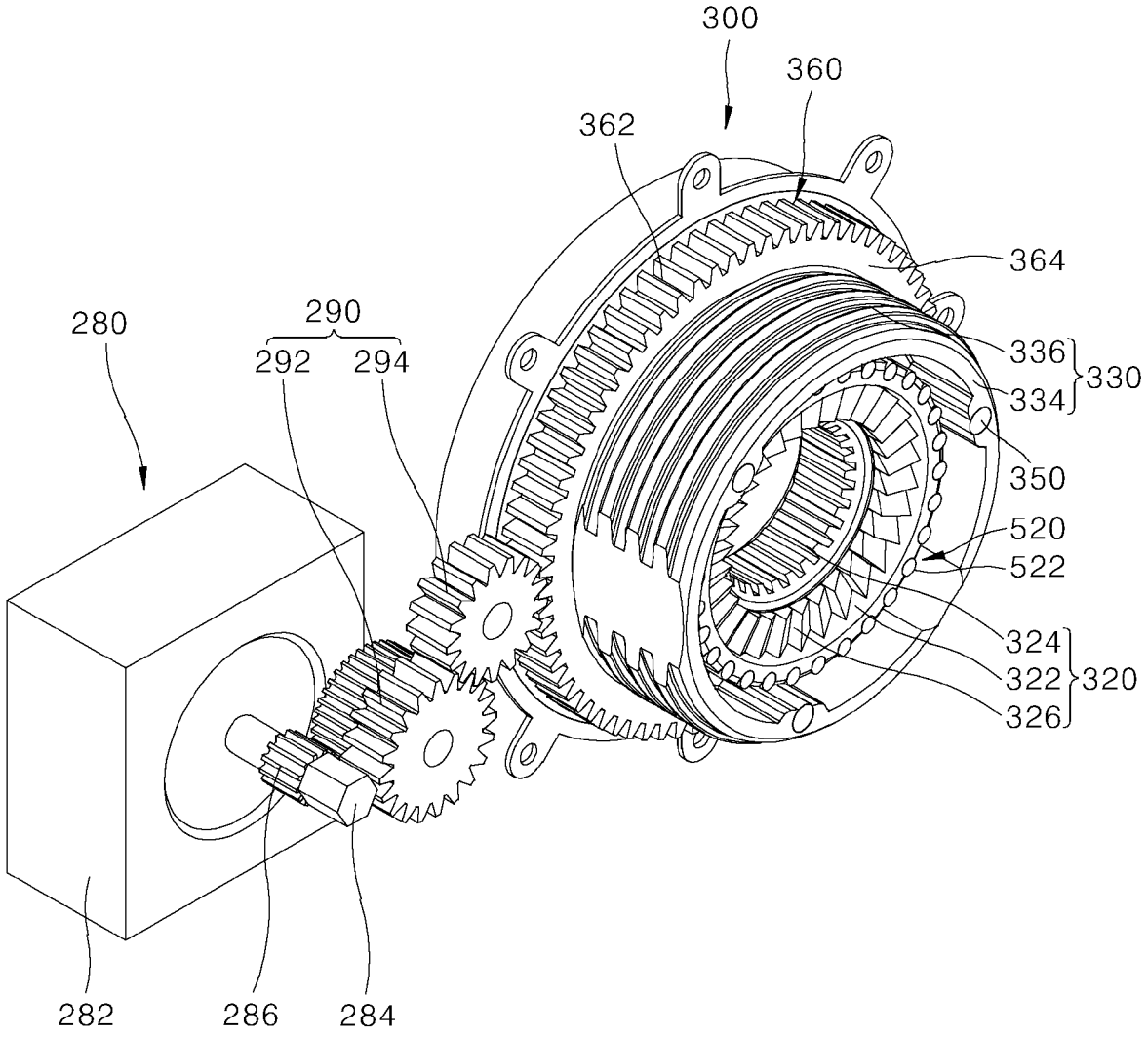

【Fig. 9】
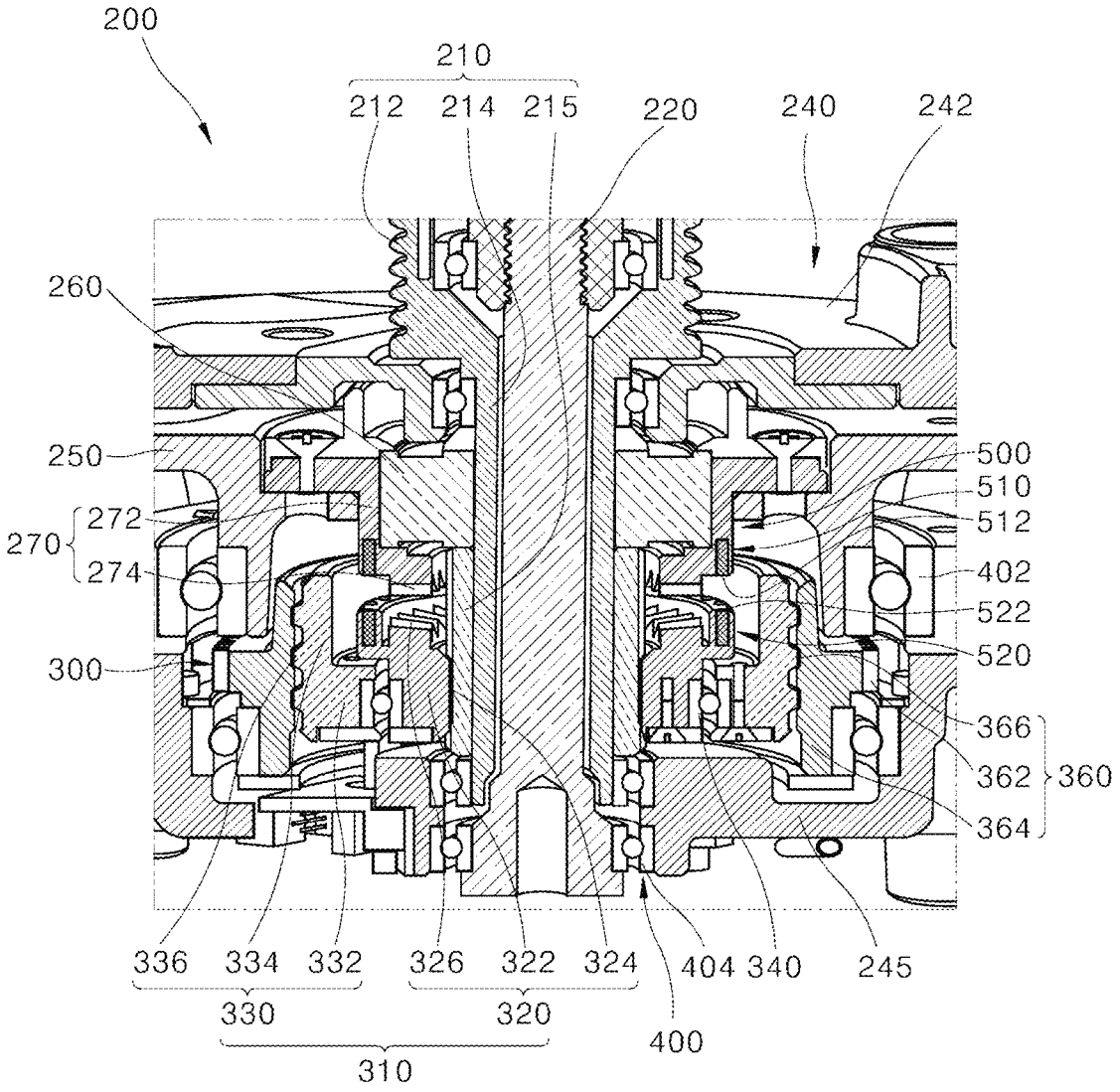

【Fig. 10】
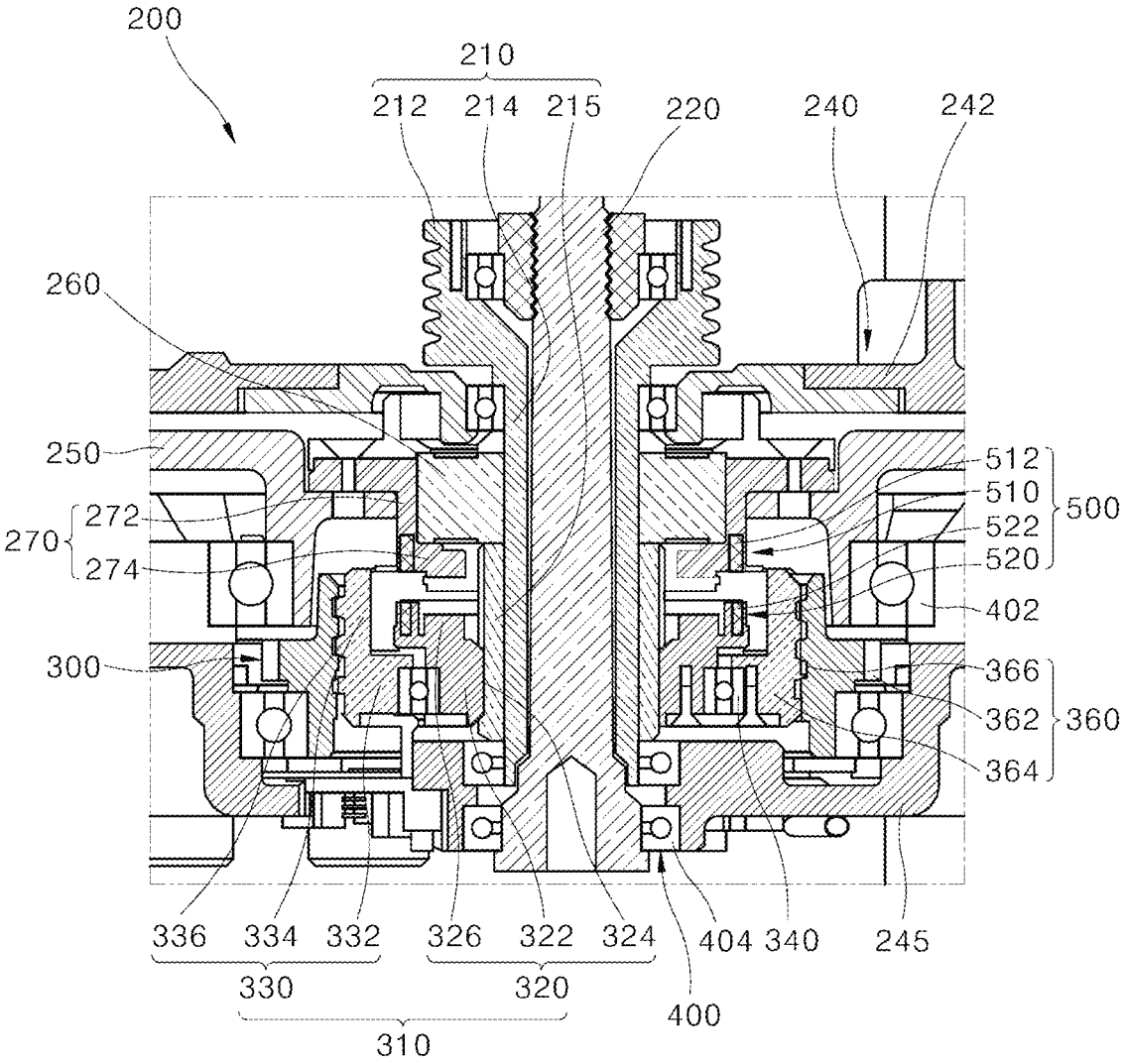

[Fig. 11]
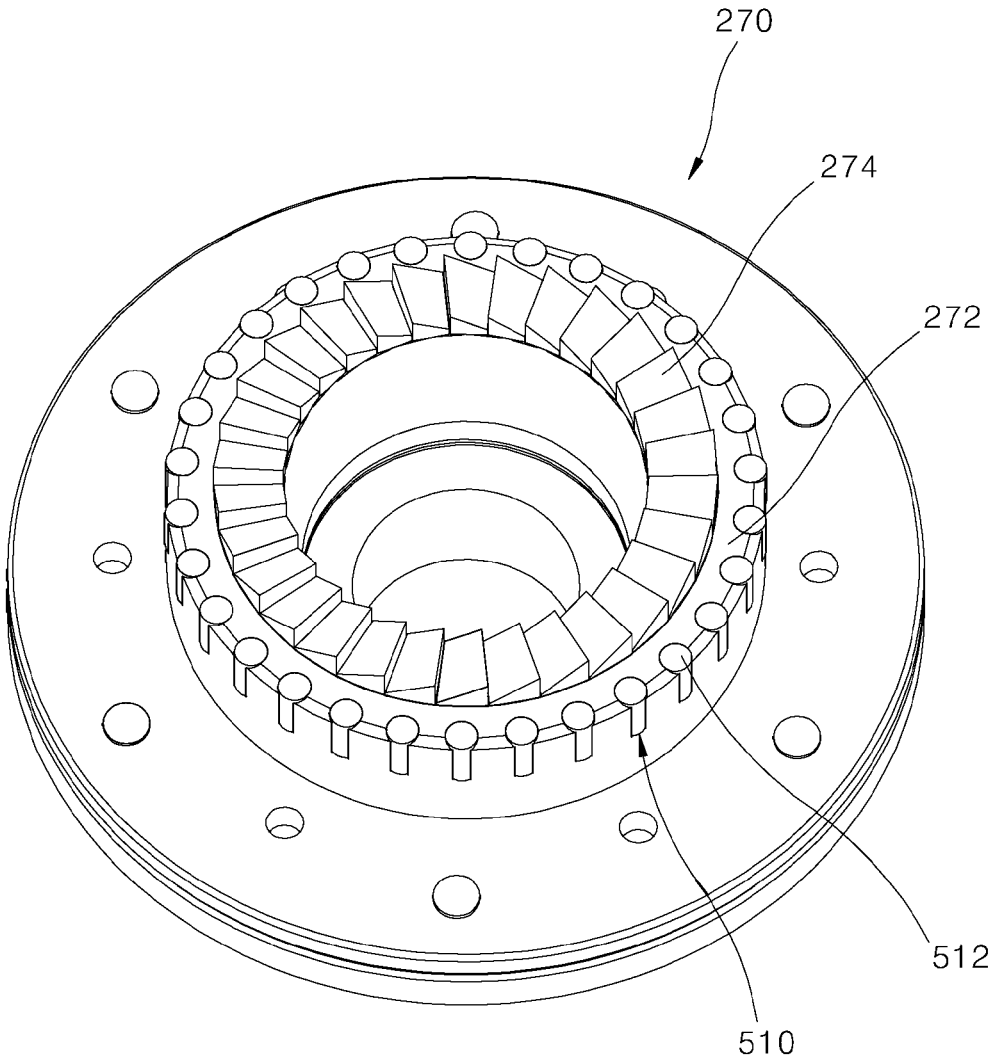

[Fig. 12]
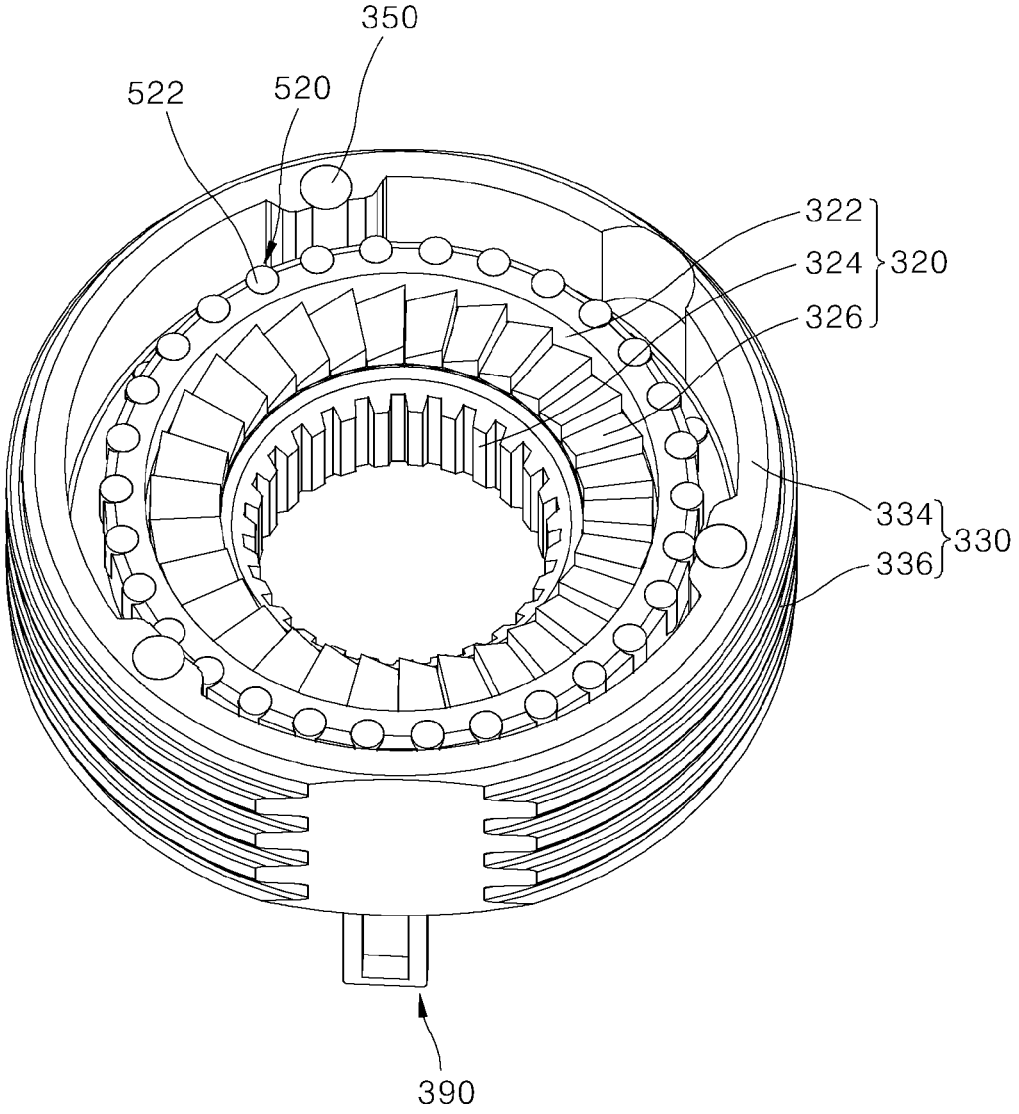

[Fig. 13]
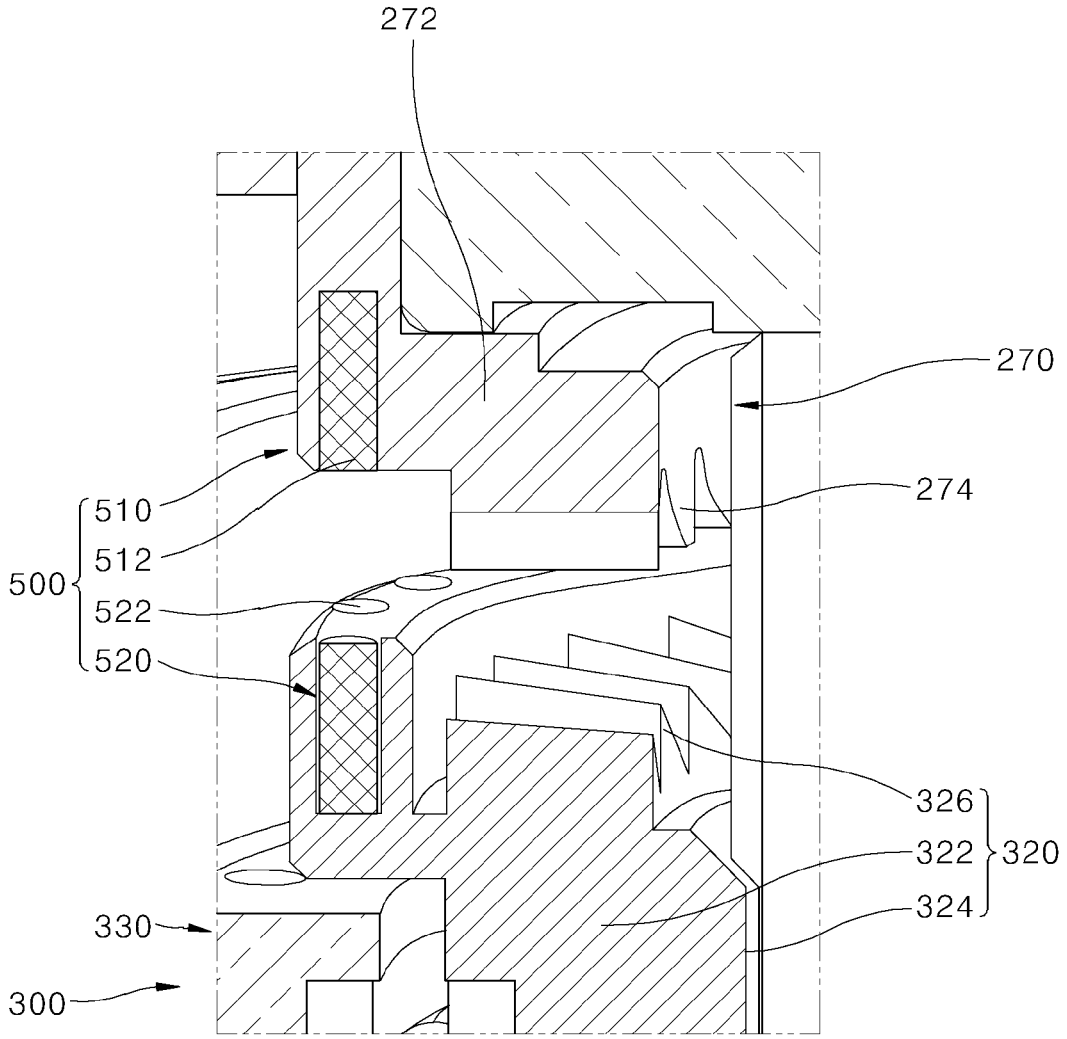

【Fig. 14】
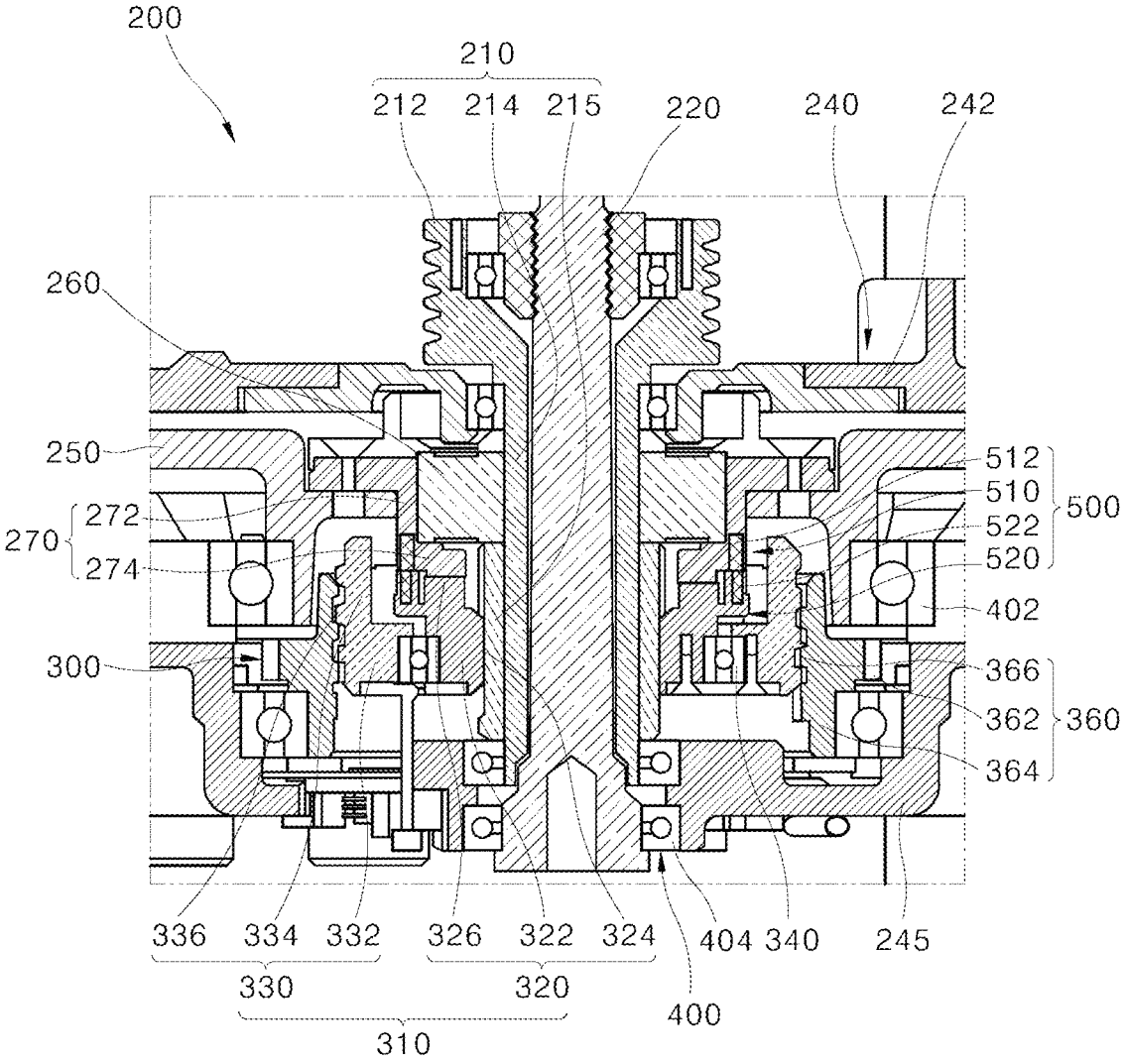

[Fig. 15]
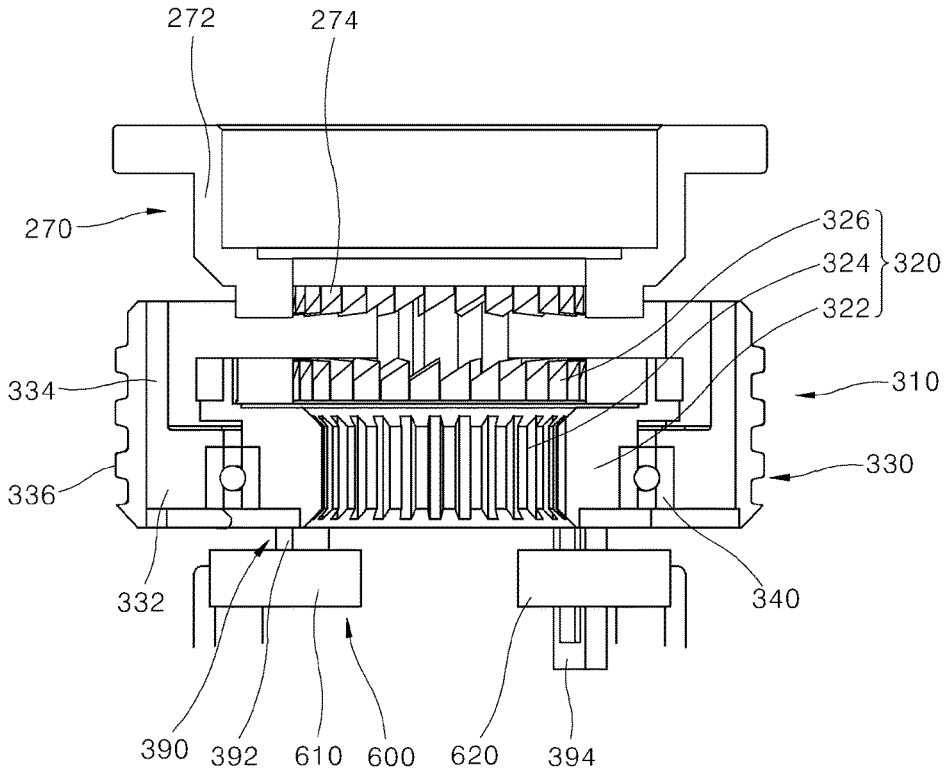
[Fig. 16]
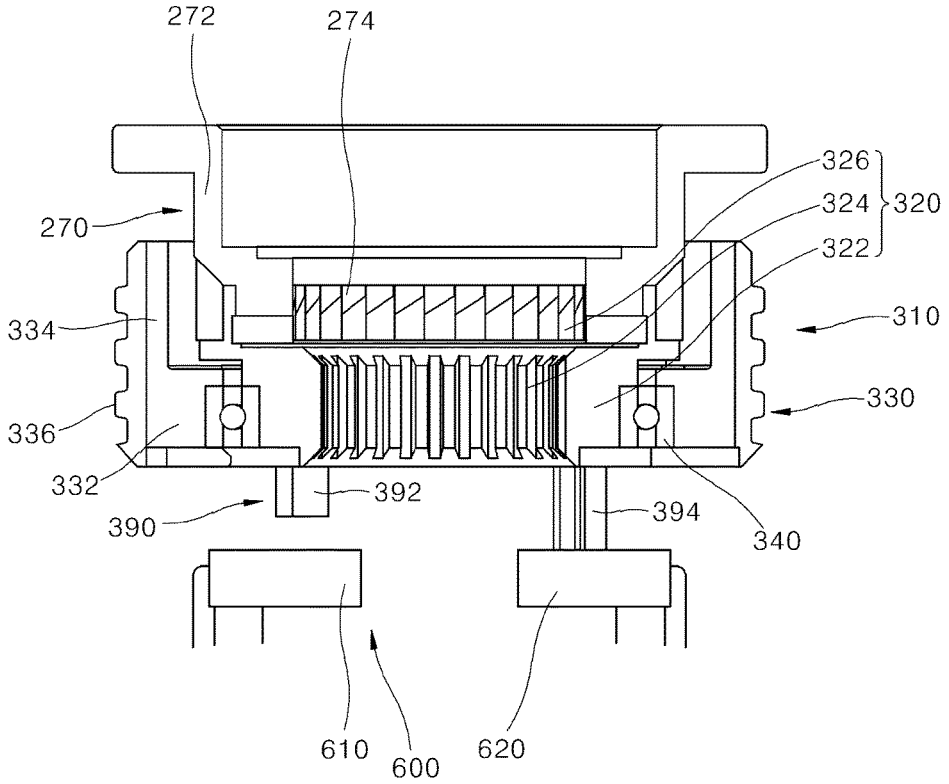

FREEWHEEL ADJUSTABLE WHEEL AND FITNESS BIKE THEREWITH

TECHNICAL FIELD

The present disclosure relates to a freewheel adjustable wheel for adjusting a position of a moving gear unit transmitting power by using magnetic force, and a fitness bike therewith.

BACKGROUND ART

In general, as indoor exercise equipment for strengthening muscle strength, weight equipment for strengthening muscle strength and aerobic exercise equipment for enhancing cardiorespiratory function are widely used as fitness equipment.

Aerobic exercise equipment is largely divided into a treadmill that allows users to walk or run on an endless track, a fitness bike that strengthens leg muscles by allowing users to rotate pedals, and a cariorespiratory exercise that provides the effect of climbing stairs.

The fitness bike is installed in a designated place, and wheels are rotated by the action of stepping on the pedals to exercise. Such the fitness bike may be divided into a spinning bike capable of performing spinning exercises and an indoor bike that rotates wheels by rotating pedals in a forward direction like a normal bike.

The freewheel structure applied to the indoor bike is configured to transmit power to the wheel only when the penal is rotated in the forward direction and not to transmit power to the wheel when the pedal is rotated in the reverse direction.

Prior art 1 of the present disclosure is disclosed in Korean Patent Registration No. 10-1641429 B1 (registered on Jul. 14, 2016, Title of Disclosure: Spinning bike).

The spinning bike of Prior art 1 has the non-freewheel structure due to the nature of exercising while pedaling, and a general indoor bike has the freewheel structure.

The non-freewheel structure applied to the spinning bike is configured to transmit power to the wheel to rotate the wheel when the penal is rotated in a forward direction and when the pedal is rotated in the reverse direction.

However, the power transmission structure of the spinning bike of Prior art 1 is different from that of the indoor bike. Accordingly, when the spinning exercise and the bike exercise are alternately performed, there is a problem of increasing the purchase cost of the exercise equipment because the spinning bike and the indoor bike have to be purchased respectively.

In addition, since Prior art 1 is not provided with a separate device for guiding avoidance of engagement of heat teeth when operated in a freewheel mode and a non-freewheel mode, there is a disadvantage in that the degree of wear of a gear increases.

In addition, since Prior art 1 is not provided with a separate sensor for sensing gear movement when operated in the freewheel mode or the non-freewheel mode, there is another disadvantage in that operation reliability is lowered.

Prior art 2 is Korean Patent Registration No. 10-1641429 B1 (registered on Jul. 14, 2016, Title of Disclosure: Spinning bike) disclosing the invention in which electricity is generated from a generator during bike exercise.

In Prior art 2, a permanent magnet is installed on a rotary wheel and a coil member is installed on a circular ring having a shape surrounding the rotary wheel. Accordingly, electricity is generated when the rotary wheel is rotated, thereby saving electricity.

However, Prior art 2 is not provided with a separate power transmission device for switching a non-freewheel mode and a freewheel mode. When the spinning exercise and the bike exercise are alternately performed, there is a still further disadvantage in that the purchase cost of the exercise equipment increases because the spinning bike and the indoor bike must be purchased respectively.

In addition, Prior art 2 is provided with a magnet installed on a rotary wheel but the magnet is used for power generation, but it is not provided with a separate device guiding engagement of a gear when the non-freewheel mode and the freewheel mode are switched, accordingly, there is a still further disadvantage in that the degree of wear of the gear increases.

Prior art 3 is Korean Utility Model Registration Publication No. 20-0472220 Y1 (Title of Disclosure: Joint structure of toy) disclosing the invention that makes it easy to mount and demount a gear by using a magnet.

In Prior art 3, a first gear is formed in a first rotation body along an outer surface of an insertion groove in a circumferential direction. A second gear is formed in a second rotation body along an outer surface of an insertion groove in a circumferential direction.

In Prior art 3, a magnet is disposed at each center of the first gear and the second gear so that the gears may be coupled to each other by a magnetic force.

However, the magnet used in Prior art 3 only guides the coupling between the first gear and the second gear by the magnetic force, but not prevent ends of teeth sharply protruding when the gears engage with each other from colliding with each other. Accordingly, there is a still further disadvantage the degree of wear of the gear increases.

DISCLOSURE OF INVENTION

Technical Problem

Accordingly, an objective of the present disclosure is to provide a freewheel adjustable wheel that may switch between a freewheel mode and a non-freewheel mode in one fitness bike, and a fitness bike therewith.

Another objective of the present disclosure is to provide a freewheel adjustable wheel that may guide gear engaging by a magnetic force when operating in a freewheel mode and a non-freewheel mode, and a fitness bike therewith.

A further objective of the present disclosure is to provide a freewheel adjustable wheel including a gear unit rotatable when engaging with each other to avoid collision between ends of teeth of the gears, and a fitness bike therewith.

A still further objective of the present disclosure is to provide a freewheel adjustable wheel including a separate sensor configured to sense gear movement when operating in a freewheel mode and a non-freewheel mode, and a fitness bike therewith.

A still further objective of the present disclosure is to provide a freewheel adjustable wheel that may selectively use a freewheel function by the driving of a motor, and a fitness bike therewith.

Aspects according to the present disclosure are not limited to the above ones, and other aspects and advantages that are not mentioned above can be clearly understood from the following description and can be more clearly understood from the embodiments set forth herein. Additionally, the aspects and advantages in the present disclosure can be realized via means and combinations thereof that are described in the appended claims.

Solution to Problem

To solve the above-noted objectives, a freewheel adjustable wheel is characterized in that it may switch between a freewheel mode and a non-freewheel mode in one fitness bike, and a fitness bike therewith.

Specifically, a moving gear may vertically moved by an operation of a drive unit, and the rotation of a clutch gear and the rotation of a clutch hub may be synchronized, thereby adjusting a freewheel mode and a non-freewheel mode.

In addition, the present disclosure is characterized in that a gear position adjusting unit is provided to guide gear engaging by a magnetic force when operated in the freewheel mode and the non-freewheel mode.

Specifically, a first adjusting unit including a magnetic force may be disposed in a first gear of which rotation is restricted, and a second adjusting unit including a magnetic force may be disposed in a second gear that is rotatable. Accordingly, the rotation of the second gear by the magnetic force may be guided and it is possible to prevent a phenomenon in that gear teeth.

A first adjusting unit may be provided along an outer circumference of a first coupling gear provided in the first gear and may include a magnetic force. A second adjusting unit may be disposed at a position facing the first adjusting unit, and provided along an outer circumference of a second gear provided in the moving gear and may include a magnetic force. The first adjusting unit and the second adjusting unit may adjust a position at which a second gear is engaged with a first gear, using an attractive force or repulsive force.

In addition, the present disclosure is characterized in that gear may be rotatably installed and avoid gear teeth engaging, when gear is engaged in a freewheel mode and a non-freewheel mode.

Specifically, a second gear engaged with a first gear may be vertically moved by the inner moving unit, and a connecting bearing may be disposed between the second gear and the inner moving unit to freely perform the rotation of the second gear. Accordingly, the second gear moved toward the first gear may be rotated when the tecth of the second gear are about to collide with each other, thereby avoiding a phenomenon in which teeth are engaged.

In addition, the present disclosure is characterized in that a protrusion detecting sensor is provided to detect gear movement when it is operated in the freewheel mode and the non-freewheel mode.

Specifically, a sensing target protrusion may be provided in a moving gear moved in an axial direction to be engaged with the first gear, and a protrusion detecting sensor may be provided to detect movement of the sensing target protrusion, thereby detecting the movement of the sensing target protrusion in the freewheel mode and the non-freewheel mode.

The sensing target protrusion may include a first protrusion extending from the inner gear provided in the moving gear, and a second protrusion extending from the inner gear, with a length longer than the length of the first protrusion.

The protrusion detecting sensor may include a first sensor installed on a movement path of the first protrusion and detecting movement of the first protrusion; and a second sensor installed on a movement path of the second protrusion and detecting movement of the second protrusion.

In addition, the present disclosure is characterized in that the freewheel mode and the non-freewheel mode are selectively used by using rotation power of the drive unit.

Specifically, when an outer rotating gear is rotated by power of the drive unit, the inner gear inside the outer rotating gear may be engaged with the outer rotating gear to be moved in an axial direction. the second gear provided in the inner gear may be engaged with the first gear coupled to the inner case, so that the power of the rotating gear rotated together with the pedal unit may be transmitted to the inner case through the inner gear and the first gear.

The rotating gear may receive power from the pedal unit to be rotated and a gear may be provided along an outer circumference.

The fixing case may rotatably support the rotating gear.

The inner case may receive power of the rotating gear to be rotated, and may be rotatably coupled to the fixing case.

A clutch bearing may be disposed between the rotating gear and the inner case, and may transmit power when the rotating gear is rotated in a forward direction.

The first gear may have a shape having one side fixed to the inner case and the other side surrounding an outer surface of the clutch bearing, and may receive power through the clutch bearing.

The drive unit may be fixed to the fixing case and supply rotation power.

The moving gear may be moved by the power of the drive unit, and operated in a non-freewheel mode of being engaged with the first gear and a freewheel mode of being spaced apart from the first gear.

In addition, the moving gear may include an inner gear engaged with a spline gear provided in the rotating gear to be rotated together, and transmitting power while being moved in an axial direction of the rotating gear and engaged with the first gear; and an outer rotating gear provided on an outer surface of the inner gear, and moving the inner gear in an axial direction of the rotating gear by an operation of being rotated by power transmitted from the drive unit.

The inner gear may include a second gear receiving power engaged with the spline gear to receive power from the rotating gear, and moved toward the first gear to be engaged with the first gear; an inner moving gear disposed between the second gear and the outer rotating gear, comprising a spiral gear engaged with an inner surface of the outer rotating gear, and moved by the rotation of the outer rotating gear to move the second gear in an axial direction; and a guide bar having a bar shape fixed to the fixing case, and restricting the rotation of the inner moving gear and guide axial rotation, in contact.'

The second gear may include a second gear body extending in a ring shape, the second gear body in which a linear gear engaged with the spline gear is disposed along an inner circumference; a second coupling gear forming teeth along an outer circumference of the second gear body facing the first gear; and a connecting bearing disposed between the second gear and the inner moving gear.

The second gear may be rotatable in a circumferential direction, and connected to the gear position adjusting unit to be rotated by a magnetic force.

The gear position adjusting unit may be installed in each of the first gear and the moving gear, and adjusts a position at which the first gear and the moving gear are engaged with each other by a magnetic force.

The gear position adjusting unit may include a first adjusting unit disposed in the first gear and comprising a magnetic force; and a second adjusting unit disposed in the second gear while facing the first adjusting unit, and comprising a magnetic force.

The first adjusting unit and the second adjusting unit may adjust a position at which the first gear and the second gear are rotated by a repulsive force or attractive force engaged with each other.

The first adjusting unit may include a plurality of first magnets connected to the first gear and disposed along a circumference of a first coupling gear engaged with the second gear.

The second adjusting unit may include a plurality of second magnets connected to the second gear and disposed along a circumference of a second coupling gear engaged with the first gear.

The first gear may include a first gear body surrounding an outer surface of the clutch bearing and fixed to the inner case; and a first coupling gear forming a gear at one end of the first gear body toward the moving gear, and engaged with a second coupling gear provided in the moving gear.

A fitness bike according to the present disclosure may include a frame unit supporting a saddle and a handle; a pedal unit provided in a rotating disc disposed on a lateral surface of the frame unit; a rotating gear rotated by a power transmitted from the pedal unit, and rotatably coupled to an outer surface of a shaft and having a spline gear disposed on an outer surface; a fixing case rotatably supporting the rotating gear, the fixing case of which rotation is restricted; a inner case rotated by a power transmitted from the rotating gear and rotatably coupled to the fixing case; a clutch bearing disposed between the rotating gear and the inner case and transmitting power when the rotating gear is rotated in a forward direction; a first gear having a shape having one side fixed to the inner case and the other side surrounding an outer surface of the clutch bearing, and receiving power through the clutch bearing; a drive unit fixed to the fixing case and supplying rotation power; a moving gear moved by power of the drive unit and operated in a non-freewheel mode of being engaged with the first gear and a freewheel mode of being spaced apart from the first gear; a gear position adjusting unit disposed in each of the first gear and the moving gear, and adjusting a position at which the first gear and the moving gear are engaged with each other by a magnetic force; and a protrusion detecting sensor disposed in the fixing case and detecting movement of the moving gear.

The gear position adjusting unit may include a first adjusting unit disposed in the first gear and having a magnetic force; and a second adjusting unit disposed in the moving gear, while facing the first adjusting unit, and having a magnetic force.

The first adjusting unit may include a plurality of first magnets connected to a first gear and disposed along a circumference of the first coupling gear engaged with first moving gear.

The second adjusting unit may include a plurality of second magnets connected to the moving gear and disposed along a circumference of a second coupling gear engaged with the first gear.

The moving gear may include an inner gear engaged with a spline gear provided in the rotating gear to be rotated together, and transmitting power while being moved in an axial direction of the rotating gear and engaged with the first gear; and an outer rotating gear provided on an outer surface of the inner gear, and moving the inner gear in an axial direction of the rotating gear by an operation of being rotated by power transmitted from the drive unit; and a sensing target protrusion having a protrusion protruding from the inner gear, and detected by the protrusion detecting sensor.

Advantageous Effects of Invention

According to the freewheel adjustable wheel and the fitness bike including the same, operation conversion between the freewheel mode and the non-freewheel mode is performed in one exercise bike, thereby reducing the purchase cost of exercise equipment.

In addition, the position at which the first gear and the second gear are engaged with each other may be adjusted by the gear position adjusting unit having a magnetic force, thereby reducing wear of gear enough to reduce maintenance cost.

In addition, the second gear engaged with the first gear may be rotatably coupled so that the teeth of the first gear and the second gear may be prevented from being engaged with each other, thereby reducing maintenance cost.

In addition, the protrusion detecting sensor may detect the movement of the sensing target protrusion provided in the moving gear, so that the gear movement may be easily detected when operated in the freewheel mode and the non-freewheel mode, thereby increasing operation reliability.

In addition, the freewheel function may be selectively used by the operation of the moving gear moved by the operation of the drive unit, thereby improving the usability of exercise equipment.

Specific effects are described along with the above-described effects in the section of detailed description.

BRIEF DESCRIPTION OF DRAWINGS

FIG. 1 is a perspective view showing a fitness bike including a freewheel adjustable wheel according an embodiment;

FIG. 2 is a front view showing a state where a freewheel adjustable wheel is mounted inside a fitness bike according to an embodiment of the present disclosure;

FIG. 3 is a perspective view showing a freewheel adjustable wheel according to an embodiment of the present disclosure;

FIG. 4 is a sectional view showing a freewheel adjustable wheel according to an embodiment of the present disclosure;

FIG. 5 is an exploded perspective view showing a freewheel adjustable wheel according to an embodiment of the present disclosure;

FIG. 6 is a perspective view showing a state where a moving gear unit and a drive unit are installed inside a second fixing case according to an embodiment of the present disclosure;

FIG. 7 is an exploded perspective view showing a first gear and a second gear according to an embodiment of the present disclosure;

FIG. 8 is a perspective view showing a moving gear unit, a power transmission unit and a drive unit according to an embodiment of the present disclosure;

FIG. 9 is a cut-away perspective view of a freewheel adjustable wheel according to an embodiment of the present disclosure;

FIG. 10 is a sectional view of a freewheel adjustable wheel according to an embodiment of the present disclosure;

FIG. 11 is a perspective view showing a first gear and a first adjusting unit according to an embodiment of the present disclosure;

FIG. 12 is a perspective view showing an inner gear portion and a second adjusting unit according to an embodiment of the present disclosure;

FIG. 13 is a perspective view showing a first adjusting unit and a second adjusting unit according to an embodiment of the present disclosure;

FIG. 14 is a perspective view showing a state where a first gear and a second gear are engaged with each other according to an embodiment of the present disclosure;

FIG. 15 is a front view showing a state where a first sensor and a second sensor detected a sensing target protrusion according to an embodiment of the present disclosure; and FIG. 16 is a front view showing a state where only a second sensor detected the blood sensing protrusion according to an embodiment of the present disclosure.

BEST MODE FOR CARRYING OUT THE INVENTION

The above-described aspects, features and advantages are specifically described hereunder with reference to the accompanying drawings such that one having ordinary skill in the art to which the present disclosure pertains can easily implement the technical spirit of the disclosure. In the disclosure, detailed descriptions of known technologies in relation to the disclosure are omitted if they are deemed to make the gist of the disclosure unnecessarily vague. Below, preferred embodiments according to the disclosure are specifically described with reference to the accompanying drawings. In the drawings, identical reference numerals can denote identical or similar components.

The terms "first", "second" and the like are used herein only to distinguish one component from another component. Thus, the components should not be limited by the terms. Certainly, a first component can be a second component unless stated to the contrary.

Hereinafter, expressions of 'a component is provided or disposed in an upper or lower portion' may mean that the component is provided or disposed in contact with an upper surface or a lower surface. The present disclosure is not intended to limit that other elements are provided between the components and on the component or beneath the component.

It will be understood that when an element is referred to as being "connected with" another element, the element can be directly connected with the other element or intervening elements may also be present. In contrast, when an element is referred to as being "directly connected with" another element, there are no intervening elements present.

Throughout the specification, unless otherwise stated, each element may be singular or plural.

A singular representation may include a plural representation unless it represents a definitely different meaning from the context. Terms such as "include" or "has" are used herein and should be understood that they are intended to indicate an existence of several components, functions or steps, disclosed in the specification, and it is also understood that greater or fewer components, functions, or steps may likewise be utilized.

Throughout the disclosure, the terms "A and/or B" as used herein can denote A, B or A and B, and the terms "C to D" can denote C or greater and D or less, unless stated to the contrary.

Hereinafter, a freewheel adjustable wheel 200 and a fitness bike therewith according to an embodiment of the present disclosure will be described.

FIG. 1 is a perspective view showing a fitness bike including a freewheel adjustable wheel 200 according an embodiment of the present disclosure. FIG. 2 is a front view showing a state where a freewheel adjustable wheel is mounted inside a fitness bike according to an embodiment of the present disclosure.

As shown in FIGS. 1 and 2, the fitness bike according to the embodiment of the present disclosure has a motion that is switched between a freewheel mode and a non-freewheel mode by an operation of a drive unit 280 using a motor.

When two gears are engaged by the operation of a gear position adjusting portion provided in the fitness bike in the non-freewheel mode, a gear may be rotated by a magnetic force, thereby preventing teeth of gears from colliding with each other.

Since using n one-way clutch bearing transmitting power only by forward rotation and not by reverse direction, the fitness bike may transmit power only during the forward rotation. Accordingly, when the fitness bile is operated in the freewheel mode, power transmission is performed only by a clutch bearing 260 which will be described later.

Since power is transmitted to a inner case 250 even during the reverse rotation of a pedal unit 40 by engaging a moving gear unit 300 moved by the drive unit 280 with a first gear 270, the fitness bike may be operated in the non-freewheel mode.

When the bike is operated in the freewheel mode, power transmission is performed through the clutch bearing 260 and low noise driving may be realized.

When the fitness bike is operated in the non-freewheel mode, a second gear 320 provided in the moving gear unit 300 may engage with a first gear 270 fixed to the inner case 250 to transmit power.

The fitness bike may be modified in various ways within the technical scope of controlling the freewheel mode operation and the non-freewheel mode operation because the moving gear unit 300 is moved by the operation of the drive unit 280. The freewheel adjustable wheel 200 may be installed inside the fitness bike and the drive unit 280 may be installed in the freewheel adjustable wheel 200.

The fitness bike according to an embodiment of the present disclosure may include at least one of a frame unit 10, a belt member 20, a discs unit 30, a pedal unit 40, a rotation support shaft 50, a base 60, a seat housing 70, a handle 80, a display 90, a seat post 100, a seat 110 and a freewheel adjustable wheel 200.

When the pedal unit 40 is rotated in the forward or reverse direction, the mode of the fitness bike according to an embodiment of the present disclosure may be easily switched between the freewheel mode and the non-freewheel mode by operating the drive unit 280.

The frame unit 10 supporting a saddle and the handle 80 may be modified in various ways within a technical scope of forming a body of the fitness bike. The frame unit 10 according to an embodiment of the present disclosure may include an outer frame 2, an inner frame 14 and a side frame 16.

The outer frame 12 is open on both open lateral surfaces, and disposed on the base 60 to be secured to the seat post 100. The freewheel adjustable wheel 200, a rotation disc and an inner disc are provided inside the outer frame 12.

The inner frame 14 may be disposed inside the outer frame 12. The inner frame 14 may support the freewheel adjustable wheel 200 disposed inside the frame unit 10. The inner frame 14 may have a shape with a plurality of connected beam members. The inner frame 14 has one side fixed to the seat post 110 and the other side supporting a shaft 220 of the freewheel adjustable wheel 200.

The side frame 16 may be coupled to both open sides of the outer frame 12. The side frame 16 may have a plate shape and may be detachably coupled to both lateral surfaces of the outer frame 12 only to facilitate repairing and exchanging work of components inside the fitness bike.

Such the frame unit 10 may be formed in various structures according to load distribution and structure of the fitness bike.

The rotation support shaft 50 may be provided inside the frame unit 10 and disposed in a horizontal direction. The rotation support shaft 50 may be connected to a disc unit 30 having a disc shape. The disc portion 30 according to an embodiment of the present disclosure may include a rotation disc and an inner disc 34.

Both sides of the rotation support shaft 50 may be connected to the inner disc. Both sides of the rotation support shaft 50 according to an embodiment of the present disclosure may be connected to the center of the inner disc.

The rotation disc with the circular shape 32 may be fixed to the outside of the inner disc 34, and the pedal unit 40 may be detachably coupled to the rim of the rotation disc 32. The pedal 40 may be coupled to the rotation disc 32, while forming a right angle with the rotation disc 32. Accordingly, when the user steps on the pedal 40, the rotation disc and the inner disc are rotated with respect to the rotation support shaft 50.

The rotation disc 32 may be formed in a shape of a circular panel. The side frame 16 may have a circular hole-shaped portion to install the rotation disc 32. Since the rotation disc 32 and the inner disc 34 are disposed in the circular hole provided in the side frame 16, components disposed inside the frame unit 10 may be shielded.

Accordingly, access to the inside of the frame unit 10 by users, infants and companion animals may be prevented, and when the pedal unit 40 is rotated, it is possible to prevent a situation in which the pedal unit 40 the components disposed inside the frame are caught in the pedal unit.

The belt member 20 may be disposed on an outer rim of the inner disc, rotation of the inner disc may rotate a rotation gear 210 provided in the adjustable freewheel wheel 200. One side of the belt member 20 may be connected to the inner disc and the other side thereof may be connected to a pulley member 212 of the rotation gear 210.

The pedal unit 40 may be rotatably mounted to the rotation disc mounted to the lateral surface of the frame unit 10. The pedal unit 40 may be mounted to the rotation disc by an operation of turning and fastening it to a fastening groove provided in the rotation disc 32.

The rotation support shaft 50 may penetrate the center of the rotation disc 32 and the center of the inner disc 34, which are rotated by the pedal. The rotation disc 32 and the inner disc 34 may function as driving wheels, and may be connected to the pulley member 212 of the rotation gear 210, which will be described later, by using a belt or chain. When the user steps on the pedal unit 40, the rotation disc 32 and the inner disc 34 are rotated. As the inner disc 34 is rotated, the belt member 20 and the rotation gear 210 are rotated.

The base 60 may be disposed on the bottom of the frame unit 10 to support the frame unit 10. The base unit 60 may be disposed in a plate shape, spaced apart from the lower surface of the frame unit 10. The base 60 may be formed in various shapes.

The seat housing 70 may be disposed along an upper surface of the base 60. The seat housing 70 has a square tube shape and extends upward from the base 60 to penetrate the inside of the frame unit 10. Also, the frame unit 10 is fixed to the seat housing 70. Accordingly, the frame unit 10 may be installed above the base 60, spaced apart therefrom.

The seat housing 70 may be inclined in a vertical direction of the frame unit 10. The seat housing 70 may be disposed between the rotation support shaft 50 and the shaft 220. The seat housing 70 may have a shape of a polygonal pipe or a circular pipe.

The handle 80 may be secured to one side of the frame unit 10. The display 90 for easily checking an operation status and exercise records of the fitness bike may be mounted to an upper surface of the frame unit 20, adjacent to the handle 80.

The display 90 may be configured to output exercise information such as speed, rotation load, etc. of the fitness bile on the screen.

The seat post 100 supporting a lower portion of the seat 110 may be disposed on an upper surface of the seat housing 70. The seat post 100 may be installed inside the seat housing 70 to be height-adjustable. The seat post 100 may be fixed inside the seat housing 70. A cross sectional area of the seat post 100 may be formed in various ways based on the shape of the seat housing 70.

Since the seat post 100 is mounted inside the seat housing 70 to be height-adjustable, the height of the seat 100 may be appropriately adjustable based on the user's height, physical conditions and exercise tendency.

In the fitness bike according to the present disclosure, the freewheel adjustable wheel 200 may be disposed in a rear area or a front area with respect to the rotation support shaft 50. The shape of the frame unit 10 may be change based on the position of the adjustable freewheel wheel 200. In addition, the positions of the rotation support shaft 50 and the shaft 220 may be changed.

FIG. 3 is a perspective view showing a freewheel adjustable wheel 100 according to an embodiment of the present disclosure. FIG. 4 is a sectional view showing a freewheel adjustable wheel 200 according to an embodiment of the present disclosure FIG. 5 is an exploded perspective view showing a freewheel adjustable wheel 200 according to an embodiment of the present disclosure.

As shown in FIGS. 3 to 5, the freewheel adjustable wheel 200 may include at least one of a rotation gear 210, shaft 220, a fixing case 240, a rotation case 250, a clutch bearing 260, a first gear 270, a drive unit 280, a power transmission unit 290, a moving gear unit 300, a bearing unit 400, a gear position adjusting unit 500, a protrusion detecting sensor 600 and a magnetic force generation unit 700.

When the mode is changed to the non-freewheel mode from the freewheel mode, the moving gear unit 300 may be moved upward and a second gear 320 provided in the moving gear unit 300 may engage with a first gear 270 to transmit power. At this time, magnets may be disposed on the first gear 270 and the second gear 320 to guide the rotation of the second gear 320, and it is possible to prevent sharp portions of gear teeth from colliding each other.

With the installation of the gear position adjusting unit 500 having a magnetic force, the teeth of the first gear 270 and the second gear 320 may not collide with each other, and may induce normal engagement.

The rotation gear 210 may be modified in various ways within the technical feature of being rotatably coupled to the outer surface of the shaft 220. The rotation gear 210 may include a gear extending along an outer circumference in an axial direction.

The rotation gear 210 according to an embodiment of the present disclosure may include a pulley member 212, a rotation body 214 and a spline gear 216.

The pulley member 212 may be connected to the belt member 20, and configured to rotate with the power transmitted from the pedal unit 40. Since the gear is provided along the outer circumference of the pulley member 212, the slip phenomenon of the pulley member 212 disposed on the outer surface of the pulley member 212. The pulley member 212 may be provided outside of the fixing case 240 and provided with the power of the pedal unit 40 through the belt member 20.

The rotation body 214 may extend to the inside of the fixing case 240, and may rotatable together with the pulley member 212. The rotation body 214 according to an embodiment of the present disclosure may have a pipe shape.

The spline gear 216 may be fixed to the outer surface of the rotation body 214, and may be modified in various ways within the technical feature that is rotatable together with the rotation body 214. The spline gear according to an embodiment may be a gear coupled to or integrally formed with the outer surface of the rotation body 214, and may extend in an axial direction of the rotation body 214.

Since the gear is formed on the outer surface of the spline gear 216, the second gear 320 of the moving gear unit 300 may be moved in the axial direction of the rotation gear 210 along the spline gear 216.

The rotation gear 210 may be mounted in the fixing case 240 and the inner case 250 to be rotated by the power of the pedal unit 40. The shaft 220 may be disposed inside the rotation gear 210. Both sides of the shaft 220 may be coupled to the inner frame 14 not to be rotatable. The rotation gear 210 may be fitted to the outside of the shaft 220. The rotation gear 210 may be disposed to be concentric with the shaft 220. The shaft bearing 404 may be disposed between the shaft 220 and the rotation gear 210. Accordingly, when the rotation gear 210 is rotated by the belt member 20, the shaft 220 may not be rotated.

The shaft 220 may be horizontally coupled through the inside of the rotation gear 210, and may be fixed to the frame unit 10. The shaft 220 according to an embodiment of the present disclosure may have a rod shaft penetrating the center of the rotation of the case.

The fixing case 240 may be modified in various ways within the technical feature that it rotatably supports the rotation gear 210 while its rotation is restricted. The fixing case 240 may be fixed to the frame unit 10 of the fitness bike so that the rotation of the fixing case 240 may be restricted, and the inner case 250 may be rotatably mounted inside the fixing case 240.

The shaft 220 may be mounted in the frame unit 10 after passing through the fixing case 240 and the inner case 250, and the rotation gear 210 may be disposed on the outer surface of the shaft 220. The rotation gear 210 may have a shape penetrating the fixing case 240 and the inner case 250.

The fixing case 240 according to an embodiment of the present disclosure may include a first fixing case 242 and a second fixing case 245. The first fixing case 242 and the second fixing case 245 may have a shape covering the outer surface of the inner case 250 with the inner case 250 interpose therebetween.

The magnetic force generation unit 700 may be disposed between the first fixing case 242 and the second fixing case 245. The magnetic force generation unit 700 may generate a magnetic force to the rotation speed or rotation load of the inner case 250 including iron.

The drive unit 280, the power transmission unit 290 and the moving gear unit 300 may be disposed in the second fixing case 245.

FIG. 6 is a perspective view showing a state where a moving gear unit 300 and a drive unit 280 are installed inside a second fixing case 245 according to an embodiment of the present disclosure. FIG. 7 is an exploded perspective view showing a first gear 270 and a second gear 320 according to an embodiment of the present disclosure.

The rotation case 250 may be rotatable with power transmitted from the rotation gear 210, and it may be modified in various ways within the technical feature that it is rotatably mounted to the fixing case 240. The rotation case 250 according to an embodiment of the present disclosure may be rotated together with the first gear 270 in contact with the clutch bearing 260. Accordingly, the rotation case 250 may be provided with a rotation power generated by a forward direction rotation through the clutch bearing 260.

The rotation gear 210 and the shaft 220 may be provided in a shape penetrating the center of the rotation case 250. The rotation case 250 may be axially coupled to the rotation gear 210, and may be rotated in the freewheel mode and the non-freewheel mode. The rotation gear 210 may be coupled to the rotation center of the rotation case 250.

When the rotation gear 210 is rotated in the forward direction in the freewheel mode, the rotation case 250 may be rotated in the forward direction. When the rotation gear 210 is rotated in the reverse direction, the rotation case 250 may not be rotated. In the freewheel mode, when the rotation gear 210 is rotated in the reverse direction, the rotation case 250 may not be rotated and the rotation gear 210 may idle in the rotation case 250.

In the non-freewheel mode, when the rotation gear 210 may be rotated in the forward direction or the reverse direction, the rotation case 250 may be rotated. Since the power input through the rotation gear 210 is transmitted to the first gear 270 through the moving gear unit 300 in the non-freewheel mode, the rotation case 250 and the rotation gear 210 may be rotated together.

The second fixing case 245 of the fixing case 240 may support the drive unit 280 and may be mounted in the open portion of the rotation case 250. The second fixing case 245 may be modified in various ways within the technical feature that it has a shape scaling the open portion of the rotation case 250 and its rotation is restricted.

The rotation case 250 may be formed in a disc shape as a whole. The rotation gear 210 may penetrate the center of the rotation case 250. An outer case for surrounding some area of the rotation case 250 may be formed along a circumference of the rotation case 250.

The wheel bearing unit 402 may be disposed between the second fixing case 245 and the rotation case 250. When the rotation case 250 is rotated in a state where the rotation of the fixing case 240 is restricted, friction may be reduced by the wheel bearing unit 402 disposed between the rotation case 250 and the fixing case 240.

The clutch bearing 260 may be disposed between the rotation gear 210 and the rotation case 25. The clutch bearing may be modified in various ways within the technical feature of transmitting power to the rotation case 250 when the rotation gear 210 is rotated in the forward direction.

A circular-shaped seating groove may be formed at the center of the rotation case to allow the clutch bearing 260 to seat thereon. The seating groove may be concentric with the rotation gear 210 and the rotation case 250. The clutch bearing 260 may be a one-way bearing that allows only one-direction rotation of the rotation gear 210. The clutch bearing 260 may transmit power to the first gear 270 fixed to the rotation case 250 so as to rotate the rotation gear 210 and the rotation case 270 together, when the rotation gear 210 is rotated in the forward direction. It may rotate only the rotation gear 210 when the rotation gear 210 is rotated in the reverse direction, and not transmit power to the rotation case 250.

Since the clutch bearing 260 rotates the rotation case 250 only when the rotation gear 210 is rotated in the forward direction, the freewheel mode of the rotation case 260 may be enabled. The clutch bearing 260 may have a structure in which a bearing (not shown) is interposed between an inner race (not shown) and an outer race (not shown). When the clutch bearing 260 is rotated in the forward direction, the bearing may be integrally rotated together by restricting the inner race and the outer race FIG. 11 is a perspective view showing a first gear 270 and a first adjusting unit 510 according to an embodiment of the present disclosure.

As shown in FIG. 11, the first gear 270 may have a shape having one side fixed to the rotation case 250 and the other side surrounding an outer surface of the clutch bearing 260. The first gear 270 may be provided with rotation power through the clutch bearing 260 when the rotation gear 210 is rotated in the forward direction.

The forward-direction rotation of the rotation gear 210 refers to the rotation when the pedal unit 40 shown in FIG. 1 is rotated in a clockwise direction.

The first gear 270 according to an embodiment of the present disclosure may include a first gear body 272 and a first coupling gear 274. The first gear body 272 may be fixed to the rotation case 250, while surrounding the outer surface of the clutching bearing 260. One end of the first gear body 272 may be fixed to the inner case 250 and the other end thereof may extend toward the second gear 320 which will be described below. The first gear body 272 may be provided in contact with the outer surface of the clutch bearing 260 and may be provided with the rotation power through the clutch bearing 260 to be rotated together with the rotation case 250.

The first coupling gear 274 may form a gear at one end of the first gear body 272 toward the moving gear unit 300, and may be engaged with or spaced apart from a second coupling gear 326 provided in the moving gear unit 300. The first coupling gear 274 may form a gear along a shape of a circumference. In addition, the teeth of the first coupling gear may have a shape inclined in one direction of rotation.

The second coupling gear 326 of the second gear 320 engaged with the first coupling gear 274 may form a gear along Accordingly, when the rotation gear 210 is rotated in the reverse direction, the first coupling gear may form a gear along a circumferential shape. In addition, the teeth of the second coupling gear may have a shape inclined in the other direction of the rotation to be engaged with the first coupling gear 274.

FIG. 8 is a perspective view showing a moving gear unit 300, a power transmission unit 290 and a drive unit 280 according to an embodiment of the present disclosure.

As shown in FIG. 8, the drive unit 280 may be fixed to the fixing case 240, and may be modified in various ways within the technical feature of supplying rotation power and moving the moving gear 300. The drive unit 280 according to an embodiment of the present disclosure may include a drive body 282 and an output shaft 284. In addition, a power gear 286 may be mounted at a circumference of the output shaft 284.

The drive body 282 may uses a motor, and the output shaft 284 protruding to the outside of the drive body 282 may be rotatable by the operation of the drive body 282. The power gear 286 disposed along the outer circumference of the output shaft 284 may extend in a ring shape, and may include a linear gear 324 extending in a longitudinal direction of the output shaft 284. The power gear 286 rotating together with the output shaft 284 may be engaged with the gear of the power transmission unit 290.

The inner gear 310 of the moving gear unit 300 may be vertically moved by the operation of the drive unit 280. Since the rotation case 250 is rotated by transmitting the power of the power gear 286 rotated by the operation of the drive unit 280 to the first gear 270 through the moving gear unit 300, the freewheel mode and the non-freewheel mode may be adjusted. In addition, the user does not have to purchase separate exercise equipment based on the freewheel mode and the non-freewheel mode, only to reduce purchase expense of exercise equipment.

The power transmission unit 290 may be modified in various ways within the technical feature that it rotates an outer rotation gear 360 provided in the moving gear unit 300 by transmitting power of the drive unit 280 to the outer rotating gear 360.

The power transmission unit 290 may transmit the power of the drive unit 280 to the outer rotating gear 360 by a plurality of gears. The power transmission unit 290 according to an embodiment of the present disclosure may include a first transmission gear 292 and a second transmission gear 294.

The first transmission gear 292 may be a gear rotated while being engaged with the power gear 286 provided in the drive unit 280, gears with different diameters may be provided in two stages. The second transmission gear 294 may be engaged with the first transmission gear 292 and the body gear 362 provided on the outside of the outer rotating gear 360, and may transmit power of the first transmission gear 292 to the body gear 362.

FIG. 9 is a cut-away perspective view of a freewheel adjustable wheel 200 according to an embodiment of the present disclosure. FIG. 10 is a sectional view of a freewheel adjustable wheel 200 according to an embodiment of the present disclosure. FIG. 12 is a perspective view showing an inner gear 310 and a second adjusting unit 520 according to an embodiment of the present disclosure.

As shown in FIGS. 8 to 12, the moving gear unit 300 may be moved by the power of the drive unit 280, and may be operated in a non-freewheel mode in which it is intermeshed with the first coupling gear 274 of the first gear 270 and a freewheel mode in which the moving gear unit 300 is separated from the first coupling gear 274.

When the moving gear unit 300 becomes spaced apart from the first coupling gear 274, the power for turning the pedal unit 40 in the forward direction may be transmitted to the inner case 250 through the rotating gear 210, the clutch bearing 260 and the first gear 270 to rotate the inner case 250. The power for turning the pedal unit 40 in the reverse direction may rotate only the spline gear 216 and the second gear 320, so the rotation power may not be transmitted to the inner case 250. Accordingly, only when the rotation gear 210 is rotated in the forward direction, the rotation of the clutch bearing 260 may be synchronized with that of the inner case 250 so that the freewheel adjustable wheel 200 may be driven in the freewheel mode.

In addition, when the rotations are synchronized by engaging the first coupling gear 274 of the moving gear unit 300 with the first coupling gear 274 of the first gear 270, the freewheel adjustable wheel 200 may be driven in the non-freewheel mode. In the non-freewheel mode, the power of the pedal unit 40 may be transmitted in the order of the rotating gear 210, the spline gear 216, the second gear 320 of the inner gear 310, the first gear 270 and the rotation case 250.

The moving gear unit 300 according to an embodiment of the present disclosure may include an inner gear 310, an outer rotating gear 360 and a sensing target protrusion 390.

The inner gear 310 may be engaged with the spline gear 216 provided in the rotating gear 210 to be rotated together with the rotating gear 210. Also, the inner gear 310 may be provided with the power of the drive unit 280 and moved along the spline gear 216 in an axial direction of the rotating gear 210, which is a linear direction. The inner gear including the second gear 320 may be modified in various ways within the technical feature that it is engaged with the first gear 270 to transmit power.

The second gear 320 may be engaged with the spline gear 216 and receive power from the rotating gear 210. The second gear 320 may be disposed outside the spline gear 26 and moved in a linear direction along the spline gear 216. The second gear 320 may be moved toward the first gear 270 to be engaged with the first gear 270 or moved to be spaced apart from the first gear 270.

The second gear 320 according to an embodiment of the present disclosure may include a second gear body 322, a linear gear 324 and a second coupling gear 326.

The second gear body 322 may extend in a ring shape, and the linear gear 324 to be engaged with the spline gear 216 may be disposed along an inner circumference. The second gear body 322 may have a pipe shape, and may be disposed outside the spline gear 216. The linear gear 324 may be disposed along the inner circumference of the second gear body 322, and may be coupled to the outer surface of the spline gear 216.

The second coupling gear 326 may form teeth along an outer circumference of the second gear body 322 facing the first coupling gear 274. The second coupling gear 326 may be formed at one end of the second gear body 322 and continuously disposed along a circumferential surface.

A connecting bearing 340 may be disposed between the second gear 320 and the inner moving gear 330, and may guide the second gear 320 to be rotated by a magnetic force.

While the first coupling gear 274 and the second coupling gear 326 are spaced apart from each other, the forward-direction rotation power transmitted through the clutch bearing 260 may be transmitted to the inner case 250 through the first gear 270. In a state where the second coupling gear 326 is in contact with the first coupling gear 274, the reverse-direction rotation power transmitted to the rotating gear 210 may be transmitted to the first gear 270 through the moving gear unit 300.

A groove for disposing the connecting bearing 340 along an outer circumference of the second gear body 322 may be provided.

The second gear 320 may be rotatably coupled in a circumferential direction and connected to the gear position adjusting unit 500 to rotate with a magnetic force.

The inner moving gear 330 may be disposed between the second gear 320 and the outer rotating gear 360, and may be modified in various ways within the technical feature of moving the second gear 320 in an axial direction of the shaft 220.

The inner moving gear 330 may include a spiral-shaped gear that is engaged with an inner portion of the outer rotating gear 360. The inner moving gear 330 may be moved by the rotation of the outer rotating gear 360 to move the second gear 320 in an axial direction.

The inner moving gear 330 according to an embodiment of the present disclosure may be gear-connected with the outer rotating gear 360, and may be moved in a linear direction together with the second gear 320 by the rotation of the outer rotating gear 360.

The rotation of the inner moving gear 330 may be restricted by a guide bar 350 so that it may be moved in the linear direction along the guide bar 350 when the outer rotating gear 360 is rotated.

The inner moving gear 330 according to an embodiment of the present disclosure may include an inner moving body 332, an inner extension 334 and an outer moving gear 336.

The inner moving body 332 may extend along an outer circumference of the second gear 320 in a ring shape, and may be connected with the second gear 320 by the connecting bearing 340. The inner moving body 332 may be provided on an outer surface of the second gear body 322, and may extend along an outer circumference of the second gear body 322.

The inner moving body 332 and the second gear body 322 may be connected by the connecting bearing 340 so that the second gear body 322 disposed inside the inner moving body 332 may be rotatably coupled.

The inner extension 334 may extend from a rim of the inner moving body 332 in an axial direction. The inner extension 334 may have a pipe shape, and an outer moving gear 336 may be disposed on outer lateral surfaces of the inner extension 334 and the inner moving body 332.

The outer moving gear 336 may have a gear disposed on an outer lateral surface of the inner extension 334 to engage with a gear provided inside the outer rotating gear 360. The outer moving gear 336 may have a male thread shape and may be engaged with the inner rotating gear 366 of the outer rotating gear 360.

The connecting bearing 340 may be disposed between the second gear 320 and the inner moving gear 330. Accordingly, the second gear 320 and the inner moving gear 330 may be moved in the axial direction of the shaft 220 together, and the second gear 320 engaged with the spline gear 216 may be rotated together with the spline gear 216.

In addition, the rotation of the inner moving gear 330 may be restricted by the guide bar 350, and only the movement thereof in a longitudinal direction of the guide bar 350 may be allowed.

The guide bar 350 may be fixed the second fixing case 245 of the fixing case 240, and may have a bar shape. The guide bar 350 may be inserted into the groove provided in the inner moving gear 330, and may guide the linear movement of the inner moving gear 330. The guide bar 350 may be provided in plural, and the plurality of guide bars may penetrate the inner moving body 332 or be inserted into the groove provided on the inner lateral surface of the inner moving body 332, to restrict the rotation of the inner moving body 332.

With the guide bar 350, the rotation of the inner moving gear 330 may be restricted and only the axial movement thereof may be guided by the guide bar 350.

The outer rotating gear 360 may be provided on an outer surface of the inner gear 310, and may be modified in various ways within the technical feature that it is rotated by the power transmitted from the drive unit 280 to move the inner gear 310 in an axial direction of the rotating gear 210.

The outer rotating gear 360 according to an embodiment of the present disclosure may include a body gear 362, a rotating gear body 364 and an inner rotating gear 366.

The body gear 362 may be connected to the power transmission unit 290 to be provided with power, and may include a gear provided on an outer circumferential surface while extend in a ring shape.

The rotating gear body 364 may be fixed inside the body gear 362, and may have a shape surrounding the outer surface of the inner gear 310. The rotating gear body 364 may have a pipe shape and may be rotatably coupled to the outer surface of the inner moving gear 330.

The inner rotating gear 366 may form a gear engaged with the gear provided on the outer surface of the inner gear on the inner lateral surface of the rotating gear body 364. The inner rotating gear 366 may be engaged with the outer moving gear 336, and the inner moving gear 330, of which the rotation is restricted by the rotation of the inner rotating gear 366, may be moved in a linear direction along the guide bar 350.

The sensing target protrusion 390 may have a shape of a protrusion protruding from the inner gear, and may be modified in various ways within the technical feature that it is measured by a protrusion detecting sensor 600. The sensing target protrusion 390 according to an embodiment of the present disclosure may include a first protrusion 392 and a second protrusion 394.

The first protrusion 392 may protrude from the inner gear 310, and may be detected by the protrusion detecting sensor 600.

The second protrusion 394 may protrude from the inner gear 310, and may be formed longer than the first protrusion 392 to be detected by the protrusion detecting sensor 600.

The first protrusion 392 and the second protrusion 394 may be disposed in parallel. When the first gear 280 is disposed above the inner gear 310, the first protrusion 392 and the second protrusion 394 may extend to a lower area of the inner gear 310.

The first protrusion 392 and the second protrusion 394 may extend along a direction in which the inner gear 310 is moved, and may have different lengths. The first protrusion 392 and the second protrusion 394 may have a shape of a rectangular frame with a hollow inside.

Meanwhile, in the freewheel adjustable wheel 200, the bearing unit 400 rotatably supporting the rotary components may include a plurality of bearings. The bearing unit 400 according to an embodiment of the present disclosure may include a wheel bearing 402 and a shaft bearing 404.

The wheel bearing 402 may be disposed between the inner case 250 and the fixing case 240 so that it may be possible to reduce friction generated between the fixing case of which the rotation is restricted and the inner case in which the rotation is performed.

The shaft bearing 220 may be disposed between the shaft 220 and the rotating gear 210, and may reduce friction generated during the rotation of the shaft 220.

FIG. 13 is a perspective view showing a first adjusting unit 510 and a second adjusting unit 520 according to an embodiment of the present disclosure.

As shown in FIGS. 10 to 13, the gear position adjusting unit 500 may be provided in the first gear 270 and the moving gear unit 300, respectively, and may be modified in various ways within the technical feature of adjusting the position at which the first gear 270 and the moving gear 300 are engaged by a magnetic force.

The gear position adjusting unit 500 according to an embodiment may include a first adjusting unit 510 and a second adjusting unit 520. The first adjusting unit 510 and the second adjusting unit 520 may adjust the position of the second gear 320 to be engaged with the first gear 270 by using attractive or repulsive force.

The gear position adjusting unit 500 may provide a semi-permanent functional structure using a permanent magnet. The gear position adjusting unit 500 may rotate the second gear 320 by using the repulsive force or attractive force, which is the magnetic force of magnets attached to the first gear 270 and the second gear 320. Accordingly, it is possible to prevent ends of the gear teeth of the first gear 270 and the second gear 320 from colliding with each other and being worn.

Since the magnetic polarities of the first adjusting unit 510 and the second adjusting unit 520 have the same polarity, the repulsive force may rotate the second gear 320. For example, the magnetic polarities of the first adjusting unit 510 and the second adjusting unit 520 may be unified to N pole or S pole.

The repulsive force, which is the property of pushing each other when they have the same magnetic polarity, may rotate the second gear 320 when the tips of the gear teeth of the first gear 270 and the second gear 320 try to collide with each other.

Since the magnetic polarities of the first adjusting unit 510 and the second adjusting unit 520 are different from each other, the attractive force may rotate the second gear 320. For example, when the magnetic polarity of the first adjusting unit 510 is the N pole, the magnetic polarity of the second adjusting unit 520 may be the S pole. Alternatively, when the magnetic polarity of the first adjusting unit 510 is the S pole, the magnetic polarity of the second adjusting unit 520 may be the N pole.

The attractive force, which is the property of attracting the magnetic polarities that are different from each other, may rotate the second gear 320 when the tips of the gear teeth of the first gear 270 and the second gear 320 try to collide with each other.

The first adjusting unit 510 and the second adjusting unit 520 may be arranged in a ring shape, and may have the same number of magnets. It is possible to control the position of gear engaging due to the positions of the magnets aligned uniformly.

When the power is converted to the non-freewheel mode, the gear engaging operation can be smoothly induced and occurrence of errors during the gear engaging operation may be prevented.

The first adjusting unit 510 may be modified in various ways within the technical feature that it is disposed in the first gear 270, with a magnetic force.

The first adjusting unit 510 may be disposed along an outer circumference of the first coupling gear 274 provided in the first gear 270. The first adjusting unit 510 may have a plurality of magnets disposed along an arc shape on an outer surface of the first coupling gear 274 arranged in an arc shape.

The first adjusting unit 510 may be integrally formed with the first gear 270, and various modifications are possible. For example, if necessary, the first adjusting unit 510 may be disposed on the outer surface of the first gear 270 as a separate member.

The first adjusting unit 510 according to an embodiment of the present disclosure may include a first magnet 512. The first magnet 512 may be connected to the first gear 270, and may be modified in various ways within the technical feature that it is disposed along an outer circumference of the first coupling gear 274 engaged with the moving gear unit 300.

The first magnet 512 according to an embodiment of the present disclosure may be provided in plural, and installed in a state of being inserted into the first gear body 272 provided on the outer surface of the first coupling gear 274. The first magnet 512 may be a permanent having a cylindrical shape and disposed so that the set polarity faces the second gear 320.

The number of first magnets 512 may be proportional to the number of gear teeth provided in the first coupling gear 274. When the number of gear teeth of the first coupling gear 274 according to an embodiment is N1 and the number of first magnets 512 is S1, N1=S1*N. here, N is a natural number.

The number of first magnets 512 according to an embodiment of the present disclosure may be equal to that of gear teeth provided in the first coupling gear 274, and the number may be changeable if necessary.

The first magnets 512 may be connected to the first gear 270 and disposed along the circumference of the first coupling gear 274 engaged with the second gear 320.

The second adjusting unit 520 may be modified in various ways within the technical feature that it is disposed in the moving gear unit 300 and has a magnetic force, while facing the first adjusting unit 510. The second adjusting unit 520 may be disposed at a position facing the first adjusting unit 510, and may be disposed along the outer circumference of the second gear 320 provided in the moving gear unit 300, with a magnetic force.

The second adjusting unit 520 according to an embodiment of the present disclosure may include a second magnet 522. The second magnet 522 may be connected to the moving gear unit 300, and may be modified in various ways within the technical feature that it is disposed along the circumference of the second coupling gear 326 engaged with the first gear 270.

The second magnet 522 according to an embodiment of the present disclosure may be installed in a state of being inserted into the second gear body 322 provided on the outer surface of the second coupling gear 326. The second magnet 522 may be a permanent having a cylindrical shape and disposed so that the set polarity faces the first gear 270.

The number of first magnets 522 may be proportional to the number of gear teeth provided in the second coupling gear 326. When the number of gear teeth of the second coupling gear 326 according to an embodiment is N1 and the number of second magnets 522 is S1, N1=S1*N. here, N is a natural number. Also, the number of first magnets 512 may be equal to that of second magnets 522.

The number of second magnets 522 according to an embodiment of the present disclosure may be equal to that of gear teeth provided in the second coupling gear 326, and the number may be changeable if necessary.

The second magnets 522 may be connected to the second gear 320 and disposed along the circumference of the second coupling gear 326 engaged with the first gear 270.

When the gear position adjusting unit 500 is operated by the repulsive force, the first magnets 512 may be disposed at positions corresponding to the gear teeth of the first gear 270. When an extension line is set radially from the center of the first gear 270, the first magnets 512 and the gear teeth of the first gear unit 270 are on the same extension line.

The second magnets 522 may be disposed at positions corresponding to the gear teeth of the second gear 320. When an extension line is set radially from the center of the second gear 320, the second magnets 522 and the gear teeth of the second gear unit 320 are on the same extension line.

Accordingly, in a state where the first magnet 512 and the second magnet 522 face each other, the gear teeth of the first gear 270 and the gear teeth of the second gear 320 face each other. At this time, the repulsive force moves the second magnet 522 in a direction in which it becomes spaced apart from the first magnet 512, and the second gear 320 may be also rotated together with the second magnet 522 so that the gear teeth of the first gear 270 and the gear teeth of the second gear 320 can be gear-connected, while not colliding with each other.

When the gear position adjusting unit 500 is operated by the attractive force, the first magnet 512 may be disposed at a position of being misaligned with the gear teeth of the first gear 270. When an extension line is set radially from the center of the first gear 270, the first magnet 512 and the gear teeth of the first gear 270 are arranged so that they are not on the same extension line.

The second magnet 522 may be disposed at a position of being misaligned with the gear teeth of the second gear 320. When an extension line is set radially from the center of the second gear 320, the second magnet 522 and the gear teeth of the second gear 320 are arranged so that they are not on the same extension line.

Accordingly, in a state where the first magnet 512 and the second magnet 522 face each other, the gear teeth of the first gear 270 and the gear teeth of the second gear 320 do not face each other. At this time, since the attractive force moves the second magnet 522 in a direction in which it becomes in contact with the first magnet 512, the second gear 320 may be rotated together with the second magnet 522 so that the gear teeth of the first gear 270 and the gear teeth of the second gear 320 can be gear-connected, while not colliding with each other.

FIG. 15 is a front view showing a state where a first sensor 610 and a second sensor 620 detected a sensing target protrusion 390 according to an embodiment of the present disclosure. FIG. 16 is a front view showing a state where only a second sensor 620 detected the sensing target protrusion600 according to an embodiment of the present disclosure.

As shown in FIGS. 15 and 16, the protrusion detecting sensor 600 may be provided in the fixing case 240, and may be modified in various ways within the technical feature of detecting the movement of the moving gear unit 300. The protrusion detecting sensor 600 according to an embodiment of the present disclosure may include a first sensor 610 and a second sensor 620.

The first sensor 610 may be disposed on the movement path of the first protrusion 392, and may detect the movement of the first protrusion 392. The second sensor 620 may be disposed on the movement path of the second protrusion 394, and may detect the movement of the second protrusion 394.

The first sensor 610 and the second sensor 620 may face each other and may be disposed on the same straight line. The installation height of the first sensor 610 and the second sensor 620 may be the same. When the inner gear 310 is moved upward, the first sensor 610 for sensing the first protrusion 392 may not operate and only the second sensor 620 for sending the second protrusion 394 may operate.

When the inner gear 310 is moved downward, the first sensor for sensing the first protrusion 392 and the second sensor 620 for sensing the second protrusion 394 may operate at the same time.

The first sensor 610 and the second sensor 620 may be sensors including a light receiving part and a light emitting part by using infrared rays. Alternatively, the first sensor 610 and the second sensor 620 may be limit sensors operated in direct contact with the sensing target protrusion 390.

The operations of the first sensor 610 and the second sensor 620 may appropriately detect the position of the inner gear 310 including the second coupling gear 326. Accordingly, the normal operation state of the freewheel mode and that of the non-freewheel mode may be easily and quickly sensed.

Hereinafter, referring to the drawings, an operational state of the freewheel wheel 200 according to an embodiment of the present disclosure and an operational state of the fitness bike including the same will be described in detail.

FIG. 14 is a perspective view showing a state where a first gear 270 and a second gear 320 are engaged with each other according to an embodiment of the present disclosure.

As shown in FIGS. 8 and 14, when an axial shaft is rotated by the operation of the drive unit 280, a power gear 286 is rotated together with the axial-force shaft to rotate the first transmission gear 292 and the second transmission gear 294. When the outer rotating gear 360 engaged with the second transmission gear 294 is rotated, the inner moving gear 330 disposed inside the outer rotating gear 360 is rotated and moved toward the first gear 270.

When the inner moving gear 330 is moved upward to the first gear 270, the position of the second gear 320 may be adjusted by the magnetic force of the first adjusting unit 510 disposed at the circumference of the first coupling gear 274 and magnetic force of the second adjusting unit 520 disposed at the circumference of the second coupling gear 326.

Since the second gear 320 may be rotated by the magnetic force of the gear position adjusting unit 500, the second gear 320 may be moved to a position at which the gear teeth of the first coupling gear 274 and the gear teeth of the second coupling gear 326 may not collide with each other.

In a state where the second gear 320 is rotated, the inner moving gear 330 may be moved upward so that the second coupling gear 326 of the second gear 320 may be engaged with the first coupling gear 274 of the first gear 270. When the pedal unit 40 is rotated in the reverse direction in a state where the second coupling gear 326 is engaged with the first coupling gear 274, the power transmitted to the rotating gear 210 may be transmitted to the first gear 270 through the spline gear 216 and the second gear 320, to rotate the inner case 250.

When the pedal unit 40 is rotated in the forward direction, power may be transmitted to the first gear 270 through the clutch bearing 260 so that the inner case 250 may be rotated in the forward direction together with the first gear 270. Accordingly, the freewheel adjustable wheel 200 and the fitness bike including the same may be operated in the non-freewheel mode.

As shown in FIGS. 8 to 10, when the axial-force shaft is operated by the operation of the drive unit 280, the power gear 286 may be rotated together with the axis-force shaft to rotate the first transmission gear 292 and the second transmission gear 294. When the outer rotating gear 360 engaged with the second transmission gear 294 is rotated, the inner moving gear 330 provided inside the outer rotating gear 360 may be rotated and moved in a direction in which it becomes spaced part from the first gear 270.

With the movement of the inner moving gear 330, the second gear 320 may also be spaced apart from the first gear 270. In case where the second coupling gear 326 is spaced apart from the first coupling gear 270, when the pedal unit 40 is rotated, power of the rotating gear 210 may not be transmitted to the inner case 250 through the first gear 270.

When the pedal unit 40 is rotated in the forward direction, power is transmitted to the first gear 270 through the clutch bearing 260. Accordingly, the inner case 250 may be rotated in the forward direction together with the first gear 270. The freewheel adjustable wheel 200 and the fitness bike including the same may be operated in the freewheel mode.

The embodiments are described above with reference to a number of illustrative embodiments thereof. However, the present disclosure is not intended to limit the embodiments and drawings set forth herein, and numerous other modifications and embodiments can be devised by one skilled in the art. Further, the effects and predictable effects based on the configurations in the disclosure are to be included within the range of the disclosure though not explicitly described in the description of the embodiments.

The invention claimed is:

1. A freewheel adjustable wheel comprising:

a rotating gear rotated by power transmitted from a pedal unit;

a fixing case rotatably supporting the rotating gear;

an inner case mounted inside the fixing case;

a clutch bearing disposed between the rotating gear and the inner case, and configured to transmit power when the rotating gear is rotated in a forward direction;

a first gear having a shape including a first side fixed to the inner case and a second side surrounding an outer surface of the clutch bearing, and configured to receive power through the clutch bearing;

a drive unit fixed to the fixing case and configured to supply rotation power;

a moving gear configured to be moved by the rotation power of the drive unit and operated in a non-freewheel mode of being engaged with the first gear and a freewheel mode of being spaced apart from the first gear; and a gear position adjusting unit disposed in each of the first gear and the moving gear, and configured to adjust a position at which the first gear and the moving gear are engaged with each other by at least one magnetic force.

2. The freewheel adjustable wheel of claim 1, wherein the gear position adjusting unit comprises:

a first adjusting unit provided along an outer circumference of a first coupling gear provided in the first gear and comprising a first magnetic force of the at least one magnetic force; and a second adjusting unit disposed at a position facing the first adjusting unit, and provided along an outer circumference of a second gear provided in the moving gear and comprising a second magnetic force of the at least one magnetic force.

3. The freewheel adjustable wheel of claim 2, wherein the first adjusting unit and the second adjusting unit adjust a position of the second gear to be engaged with the first gear by using the first magnetic force or the second magnetic force, and wherein the first magnetic force or the second magnetic force includes an attractive force or a repulsive force engaged with each other.

4. The freewheel adjustable wheel of claim 1, wherein the moving gear comprises:

an inner gear engaged with a spline gear provided in the rotating gear to be rotated together, and transmitting power while being moved in an axial direction of the rotating gear and engaged with the first gear; and an outer rotating gear provided on an outer surface of the inner gear, and moving the inner gear in the axial direction of the rotating gear by an operation of being rotated by the rotation power transmitted from the drive unit.

5. The freewheel adjustable wheel of claim 4, wherein the inner gear comprises:

a second gear receiving power when engaged with the spline gear to receive power from the rotating gear, and moved toward the first gear to be engaged with the first gear;

an inner moving gear disposed between the second gear and the outer rotating gear, comprising a spiral gear engaged with an inner surface of the outer rotating gear, and moved by rotation of the outer rotating gear to move the second gear in the axial direction of the rotating gear; and a guide bar having a bar shape fixed to the fixing case, and restricting rotation of the inner moving gear and guide axial rotation of the inner moving gear when in contact with the inner moving gear.

6. The freewheel adjustable wheel of claim 5, wherein the second gear comprises:

a second gear body extending in a ring shape, the second gear body in which a linear gear engaged with the spline gear is disposed along an inner circumference of the second gear body;

a second coupling gear forming teeth along an outer circumference of the second gear body facing the first gear; and a connecting bearing disposed between the second gear and the inner moving gear.

7. The freewheel adjustable wheel of claim 5, wherein the second gear is rotatable in a circumferential direction, and connected to the gear position adjusting unit to be rotated by the at least one magnetic force.

8. The freewheel adjustable wheel of claim 5, wherein the gear position adjusting unit comprises:

a first adjusting unit disposed in the first gear and comprising a first magnetic force of the at least one magnetic force; and a second adjusting unit disposed in the second gear while facing the first adjusting unit, and comprising a second magnetic force of the at least one magnetic force.

9. The freewheel adjustable wheel of claim 8, wherein the first adjusting unit and the second adjusting unit adjusts a position at which the first gear and the second gear are rotated by the first magnetic force or the second magnetic force, and wherein the first magnetic force or the second magnetic force includes a repulsive force or attractive force engaged with each other.

10. The freewheel adjustable wheel of claim 8, wherein the first adjusting unit comprises a plurality of first magnets connected to the first gear and disposed along a circumference of a first coupling gear engaged with the second gear.

11. The freewheel adjustable wheel of claim 8, wherein the second adjusting unit comprises a plurality of second magnets connected to the second gear and disposed along a circumference of a second coupling gear engaged with the first gear.

12. The freewheel adjustable wheel of claim 1, wherein the first gear comprises:

a first gear body surrounding the outer surface of the clutch bearing and fixed to the inner case; and a first coupling gear formed at one end of the first gear body toward the moving gear, and engaged with a second coupling gear provided in the moving gear.

13. A fitness bike comprising:

a frame unit supporting a saddle and a handle;

a pedal unit provided in a rotating disc disposed on a lateral surface of the frame unit;

a rotating gear configured to be rotated by a power transmitted from the pedal unit, and rotatably coupled to an outer surface of a shaft and having a spline gear disposed on an outer surface of a rotation body of the rotating gear;

a fixing case rotatably supporting the rotating gear while rotation of the rotating gear is restricted;

an inner case mounted inside the fixing case;

a clutch bearing disposed between the rotating gear and the inner case and configured to transmit power when the rotating gear is rotated in a forward direction;

a first gear having a shape including a first side fixed to the inner case and a second side surrounding an outer surface of the clutch bearing, and configured to receive power through the clutch bearing;

a drive unit fixed to the fixing case and configured to supply rotation power;

a moving gear configured to be moved by the rotation power of the drive unit and operated in a non-freewheel mode of being engaged with the first gear and a freewheel mode of being spaced apart from the first gear;

a gear position adjusting unit disposed in each of the first gear and the moving gear, and configured to adjust a position at which the first gear and the moving gear are engaged with each other by at least one magnetic force; and a protrusion detecting sensor disposed in the fixing case and configured to detect movement of the moving gear.

14. The fitness bike of claim 13, wherein the gear position adjusting unit comprises:

a first adjusting unit disposed in the first gear and having a first magnetic force of the at least one magnetic force; and a second adjusting unit disposed in the moving gear, while facing the first adjusting unit, and having a second magnetic force of the at least one magnetic force.

15. The fitness bike of claim 14, wherein the first adjusting unit comprises a plurality of first magnets connected to the first gear and disposed along a circumference of a first coupling gear engaged with the moving gear.

16. The fitness bike of claim 14, wherein the second adjusting unit comprises a plurality of second magnets connected to the moving gear and disposed along a circumference of a second coupling gear engaged with the first gear.

17. The fitness bike of claim 14, wherein the moving gear comprises:

an inner gear engaged with the spline gear provided in the rotating gear to be rotated together, and transmitting power while being moved in an axial direction of the rotating gear and engaged with the first gear;

an outer rotating gear provided on an outer surface of the inner gear, and moving the inner gear in the axial direction of the rotating gear by an operation of being rotated by the rotation power transmitted from the drive unit; and a sensing target protrusion protruding from the inner gear, and detected by the protrusion detecting sensor.

18. The fitness bike of claim 17, wherein the sensing target protrusion comprises:

a first protrusion protruding from the inner gear; and a second protrusion protruding from the inner gear, with a length longer than a length of the first protrusion.

19. The fitness bike of claim 18, wherein the protrusion detecting sensor comprises:

a first sensor disposed on a movement path of the first protrusion and detecting movement of the first protrusion; and a second sensor disposed on a movement path of the second protrusion and detecting movement of the second protrusion.

20. The fitness bike of claim 13, wherein the inner case is rotated by power transmitted from the rotating gear, and rotatably coupled to the fixing case.

* * * * *